US008281756B2

(12) United States Patent
Suzuki et al.

(10) Patent No.: US 8,281,756 B2
(45) Date of Patent: Oct. 9, 2012

(54) VALVE TIMING CONTROL APPARATUS

(75) Inventors: Shigemitsu Suzuki, Takahama (JP); Naoto Toma, Kariya (JP); Masaki Kobayashi, Okazaki (JP); Kenji Ikeda, Anjo (JP); Takeo Asahi, Karlya (JP); Eiji Miyachi, Nishio (JP); Yuichi Kato, Karlya (JP); Yasutaka Miura, Anjo (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 432 days.

(21) Appl. No.: 12/642,170

(22) Filed: Dec. 18, 2009

(65) Prior Publication Data

US 2010/0212615 A1 Aug. 26, 2010

(30) Foreign Application Priority Data

Feb. 26, 2009 (JP) ..... 2009-044747
Sep. 29, 2009 (JP) ..... 2009-225236

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | |
|---|---|---|---|
| 4,421,074 | A | 12/1983 | Garcea et al. |
| 6,053,139 | A | 4/2000 | Eguchi et al. |
| 6,745,735 | B2 | 6/2004 | Smith |
| 2006/0124094 | A1 | 6/2006 | Kanada et al. |
| 2007/0251477 | A1 | 11/2007 | Nozawa et al. |
| 2008/0047515 | A1 | 2/2008 | Noguchi |

FOREIGN PATENT DOCUMENTS

| | | | |
|---|---|---|---|
| DE | 199 18 910 | A1 | 4/1999 |
| DE | 101 62 553 | A1 | 8/2002 |
| EP | 1 355 046 | A2 | 10/2003 |
| EP | 1 672 187 | A1 | 6/2006 |
| EP | 2 006 499 | A2 | 12/2008 |
| GB | 2 080 923 | A | 2/1982 |
| JP | 11-173119 | A | 6/1999 |
| JP | 11-343824 | A | 12/1999 |

OTHER PUBLICATIONS

Extended Search Report issued Jul. 16, 2010 by the European Patent Office in European Patent Application No. 09 01 5967.4.

*Primary Examiner* — Zelalem Eshete
(74) *Attorney, Agent, or Firm* — Buchanan Ingersoll & Rooney PC

(57) ABSTRACT

A valve timing control apparatus includes a driving-side rotating member, a driven-side rotating member arranged coaxially with the driving-side rotational member so as to be rotatable relative to the driving-side rotating member, a retarded angle chamber and an advanced angle chamber, each of which is defined by the driving-side rotating member and the driven-side rotating member, a lock mechanism locking a relative rotational phase of the driven-side rotating member at a predetermined phase between a most advanced angle phase and a retarded angle phase, an operation fluid supply-and-discharge mechanism supplying/discharging an operation fluid to/from the retarded angle chamber, the advanced angle chamber and the lock mechanism, and a first air inlet mechanism for connecting one of the retarded angle chamber and the advanced angle chamber to an outside of the valve timing control apparatus in order to allow air to flow thereinto.

20 Claims, 12 Drawing Sheets

VALVE TIMING CONTROL APPARATUS

CROSS REFERENCE TO RELATED APPLICATIONS

This application is based on and claims priority under 35 U.S.C. §119 to Japanese Patent Application 2009-044747, filed on Feb. 26, 2009, and Japanese Patent Application 2009-225236, filed on Sep. 29, 2009, the entire contents of which are incorporated herein by reference.

TECHNICAL FIELD

The present invention generally relates to a valve timing control apparatus for controlling an opening and a closing timing of an air intake valve and an exhaust valve of an internal combustion engine for a vehicle.

BACKGROUND

Generally, according to an engine (an internal combustion engine) for a vehicle and the like having a lock mechanism, a phase formed between a driving-side rotating member and a driven-side rotating member is set at an appropriate initial phase, so that the engine is started while forming the initial phase. Accordingly, an intake timing and an ignition timing of the engine are optimized.

Disclosed in JPH11-173119A is a valve timing control apparatus, which is provided at an internal combustion engine having a lock mechanism. According to the valve timing control apparatus disclosed in JPH11-173119A, a phase formed between a driving-side rotating member and a driven-side rotating member when the internal combustion engine is stopped is returned to a phase formed when the internal combustion engine is started by using an inertial rotation of the engine, which is generated when the internal combustion engine is stopped.

More specifically, according to the valve timing control apparatus disclosed in JPH11-173119A, in a case where the internal combustion engine is stopped, both of a retarded angle chamber and an advanced angle chamber, each of which is defined by the driving-side rotating member and the driven-side rotating member, are connected to passages that are used for supplying and discharging the operation oil therefrom. Accordingly, while the internal combustion engine is being rotated by its inertia after the internal combustion engine is stopped, the operation oil is discharged from the retarded angle chamber and the advanced angle chamber via the respective passages. As a result, the driven-side rotating member rotates relative to the driving-side rotating member towards the advanced angle chamber (i.e. towards a retarded angle phase, in a retarded angle direction) by a reaction force acting on a camshaft in order to actuate the lock mechanism.

In other words, the valve timing control apparatus disclosed in JPH11-173119A is configured so that the driven-side rotating member inertially rotates when the internal combustion engine is stopped and so that the driven-side rotating member smoothly moves towards the advanced angle chamber (i.e. towards the retarded angle phase, in the retarded angle direction) by using the reaction force acting on the camshaft. The driving-side rotating member and the driven-side rotating member rotate so as to form the advanced angle phase (i.e. in the advanced angle direction) by inertia, while a rotation of the driven-side rotating member is intermittently interrupted by the reaction force acting on the camshaft. Accordingly, a vane provided at the driven-side rotating member moves towards the advanced angle chamber (i.e. towards the retarded angle phase) while repeatedly moving towards and away from the advanced angle chamber (i.e. in the retarded angle direction). In other words, the vane moves towards the advanced angle chamber (i.e. in the retarded angle direction) in response to an average torque of a torque fluctuation of the cam. In this case, because both of the advanced angle chamber and the retarded angle chamber are in communication with an outside of the valve timing control apparatus, the operation fluid freely flows towards/from the advanced angle chamber and the retarded angle chamber, which are formed across the vane. In other words, according to the valve timing control apparatus disclosed in JPH11-173119A, the vane (i.e. the driven-side rotating member) is smoothly moved, so that the phase formed between the driving-side rotating member and the driven-side rotating member is changed to a lock phase in order to smoothly start the engine.

However, in the valve timing control apparatus disclosed in JPH11-173119A, the operation fluid may not be appropriately discharged from the advanced angle chamber and the retarded angle chamber only by connecting the advanced angle chamber and the retarded angle chamber with the respective flow passages for supplying and discharging the operation fluid when the internal combustion engine is stopped. For example, even in a case where the operation fluid freely flow into/from the advanced angle chamber and the retarded angle chamber (i.e. even in a case where a flow of the operation fluid is not controlled by a valve and the like), the operation fluid remains within the advanced angle chamber and the retarded angle chamber while the internal combustion engine is being completely stopped. Therefore, for example, in a case where the internal combustion engine stalls while an ambient temperature is low and while a temperature of the operation fluid is not sufficiently increased, an operation resistance of the vane may increase because viscosity of the operation fluid remaining within the advanced angle chamber and the retarded angle chamber is high. Accordingly, the lock mechanism may not actuate before the inertial rotation of the driven-side rotating member is completely stopped.

Furthermore, according to the valve timing control apparatus disclosed in JPH11-173119A, even in a case where the driving-side rotating member and the driven-side rotating member form an initial phase, by which the valve timing control apparatus is locked, the lock mechanism may be improperly actuated. In other words, even if the driving-side rotating member and the driven-side rotating member form the initial phase, both of the driving-side rotating member and the driven-side rotating member still rotate relative to each other when the internal combustion engine is stopped. Therefore, a time for the driving-side rotating member and the driven-side rotating member forming the initial phase is relatively short. In this case, the operation fluid remains within an engagement groove of the lock mechanism. Accordingly, an engagement piece may not be inserted into the engagement groove because the fluid remaining therewithin causes resistance. The above-described situation is more likely to occur when the ambient temperature is low, where the viscosity of the operation oil becomes high.

Accordingly, there is room for the known valve timing control apparatus to be improved so that the valve timing control apparatus smoothly starts the internal combustion engine under various circumstances and environments.

A need thus exists to provide a valve timing control apparatus which is not susceptible to the drawback mentioned above.

SUMMARY

According to an aspect of this disclosure, a valve timing control apparatus includes a driving-side rotating member synchronously rotatable with a crankshaft of an internal combustion engine, a driven-side rotating member arranged coaxially with the driving-side rotational member so as to be rotatable relative to the driving-side rotating member and integrally rotatable relative to a camshaft that controls opening and closing operations of a valve of the internal combustion engine, a retarded angle chamber defined by the driving-side rotating member and the driven-side rotating member, the retarded angle chamber used for changing a relative rotational phase of the driven-side rotating member relative to the driving-side rotating member in a retarded angle direction in a manner where a volume of the retarded angle chamber is changed, an advanced angle chamber defined by the driving-side rotating member and the driven-side rotating member, the advanced angle chamber used for changing the relative rotational phase of the driven-side rotating member relative to the driving-side rotating member in an advanced angle direction in a manner where a volume of the advanced angle chamber is changed, a lock mechanism locking the relative rotational phase of the driven-side rotating member at a predetermined phase between a most advanced angle phase and a retarded angle phase, an operation fluid supply-and-discharge mechanism supplying and discharging an operation fluid to and from the retarded angle chamber, the advanced angle chamber and the lock mechanism, and a first air inlet mechanism for connecting one of the retarded angle chamber and the advanced angle chamber to an outside of the valve timing control apparatus in order to allow air to flow into the one of the retarded angle chamber and the advanced angle chamber.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

First Embodiment

A first embodiment, in which a valve timing control apparatus is adapted at an air intake valve of an engine for a vehicle, will be described below in accordance with FIGS. 1 to 9 of the attached drawings. Illustrated in FIGS. 2 to 5 are cross-sectional diagrams illustrating the valve timing control apparatus when being viewed in an axial direction of the valve timing control apparatus from a rear plate 23 towards a front plate 22.

[Entire Configuration]

Figure 1:
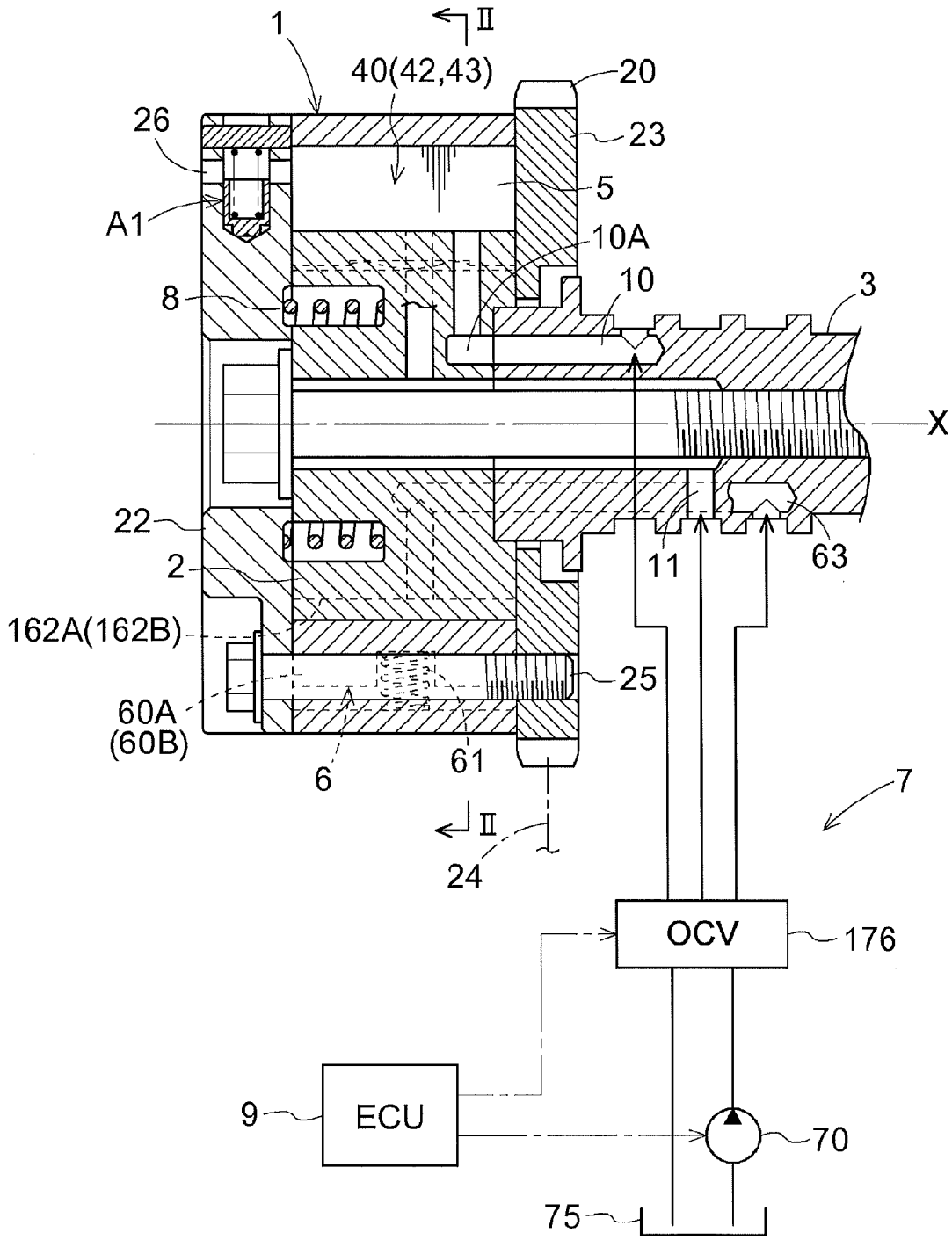
FIG. 1 is a diagram illustrating an entire configuration of a valve timing control apparatus according to a first embodiment.
Figure 2:
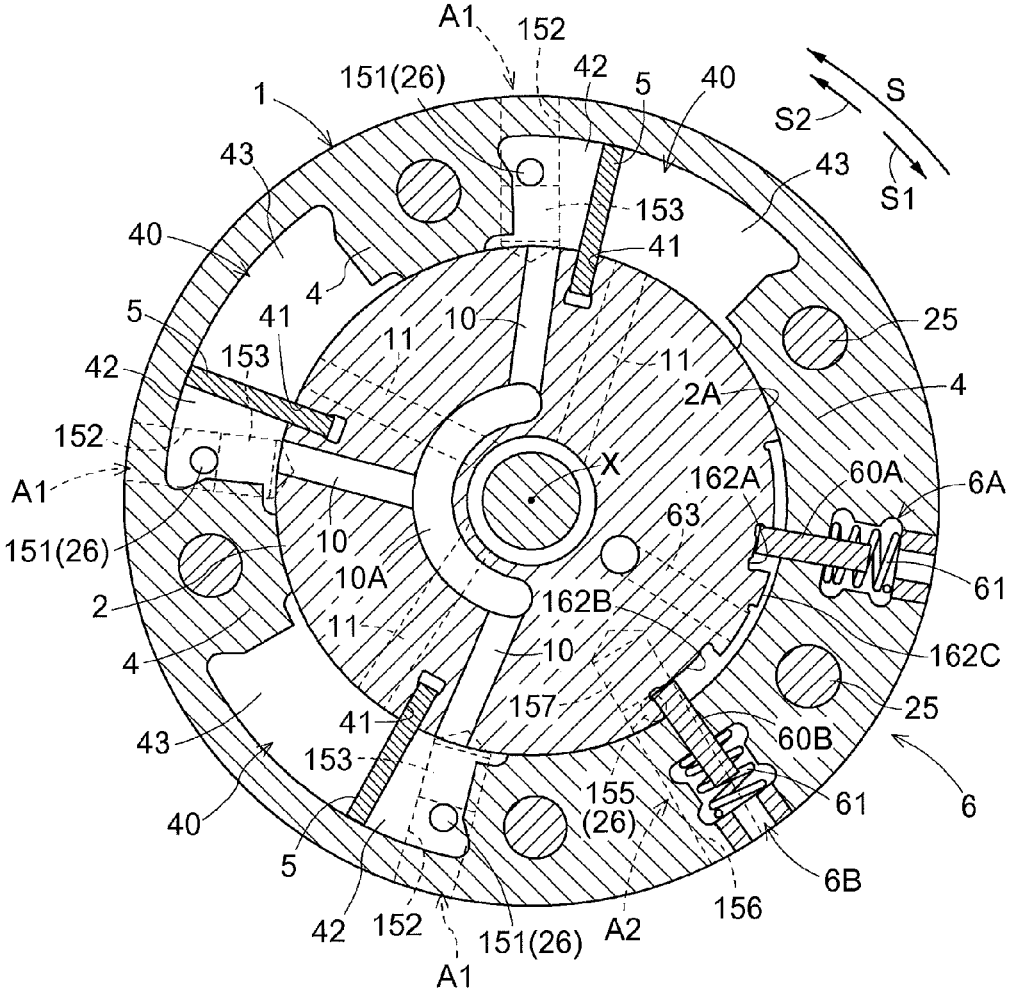
FIG. 2 is a diagram taken along line II-II in FIG. 1 and illustrating a locked state of the valve timing control apparatus.
Figure 3:
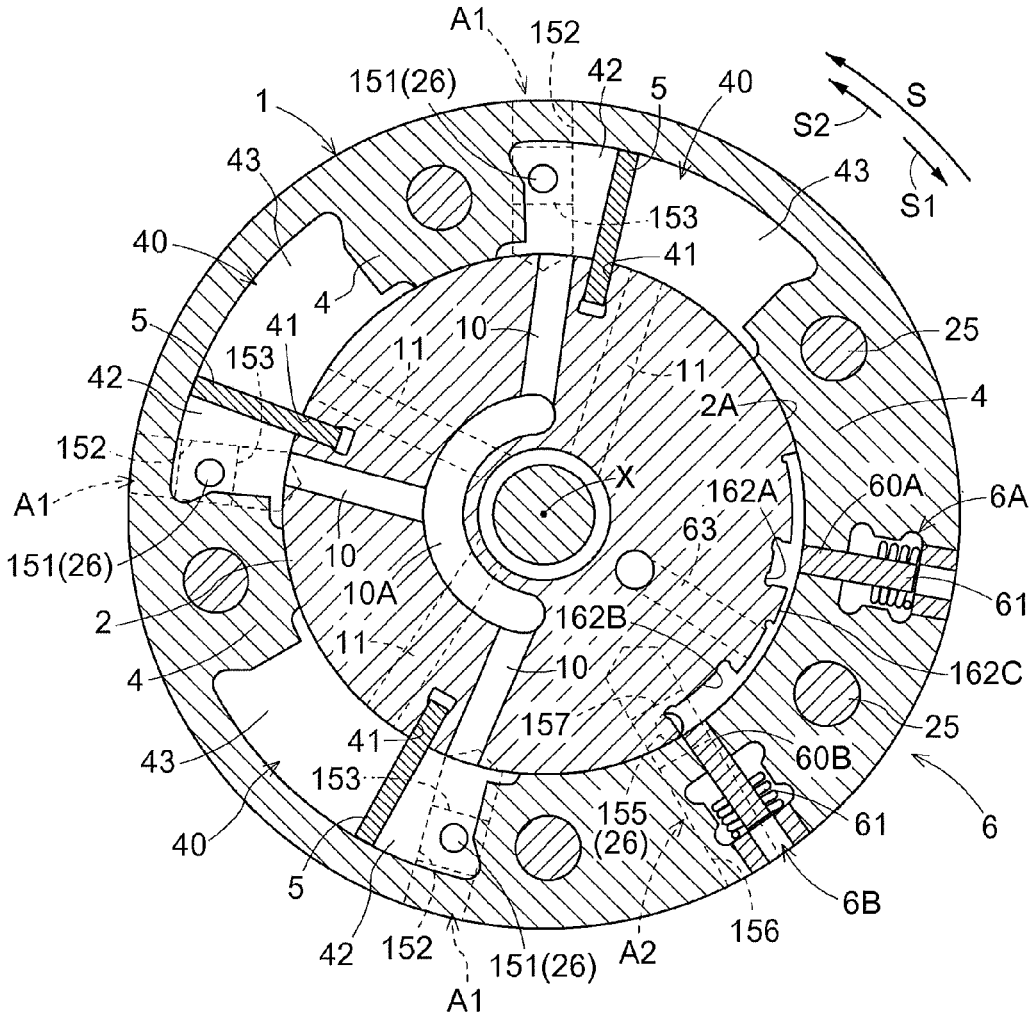
FIG. 3 is a cross-sectional diagram illustrating the valve timing control apparatus in an unlocked state.
Figure 4:
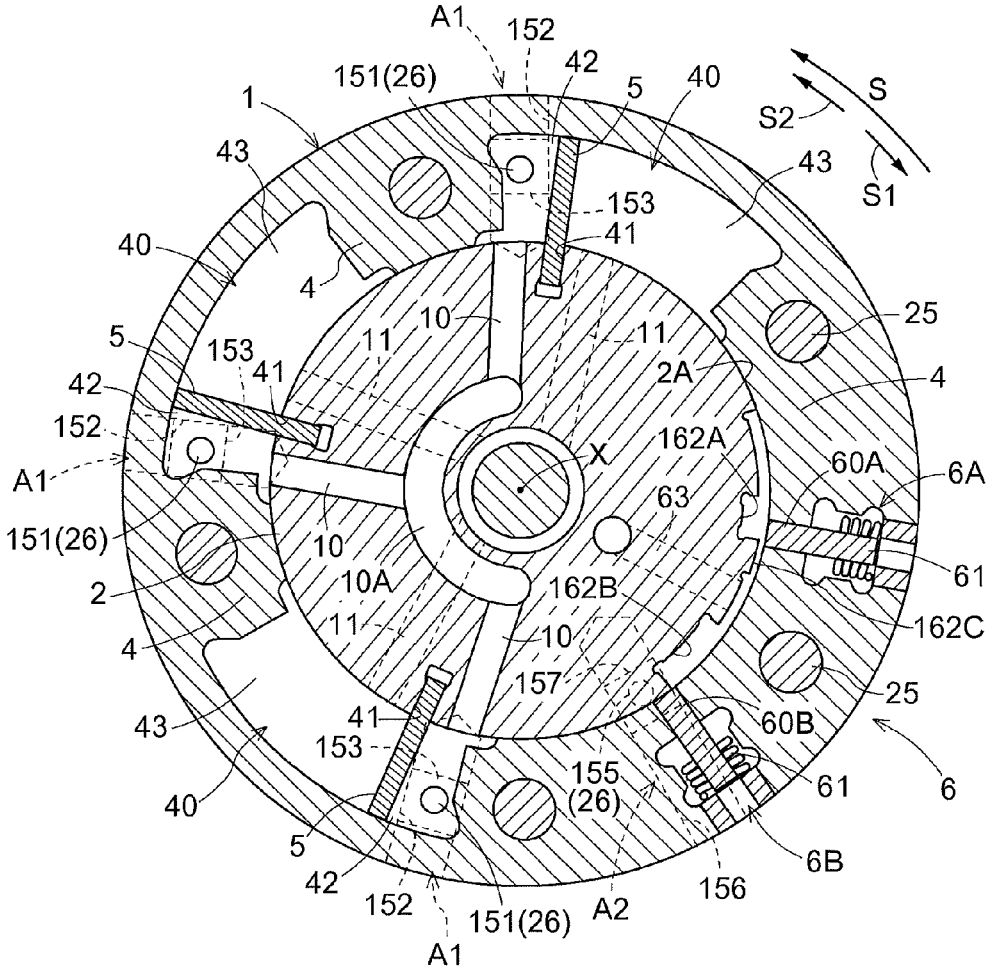
FIG. 4 is a cross-sectional diagram illustrating the valve timing control apparatus while being actuated.

As illustrated in FIGS. 1 and 2, the valve timing control apparatus according to the first embodiment includes an outer rotor 1, which serves as a driving-side rotating member, and an inner rotor 2, which serves as a driven-side rotating member. The outer rotor 1 is synchronously rotated with a crankshaft of the engine (an internal combustion engine). The inner rotor 2 is arranged coaxially with a camshaft 3 so as to be synchronously rotatable therewith. The camshaft 3 controls opening and closing operations of the air intake valve or an exhaust valve provided at a combustion chamber of the engine.

The outer rotor 1 and the inner rotor 2 are arranged so as to be rotatable relative to each other about a single relative rotational axis X. Plural fluid pressure chambers 40 are formed between the outer rotor 1 and the inner rotor 2. Furthermore, each of the fluid pressure chambers 40 is divided into a retarded angle chamber 42 and an advanced angle chamber 43 by means of a vane 5, which is provided within each of the fluid pressure chambers 40. The relative rotational axis X corresponds to a rotational axis in this embodiment. Each of the vanes 5 is provided at an outer circumferential surface of the inner rotor 2 so as to outwardly extend in a radial direction of the inner rotor 2 and so as to slidably contact a radially outer circumferential surface of the respective fluid pressure chambers. In a case where volumes of the respective retarded angle chamber 42 are increased when an operation oil (i.e. an example of an operation fluid) is supplied thereto, the vanes 5 are displaced towards the respective advanced angle chambers 43 (in a retarded angle direction S1) so as to form the retarded rotational phase between the outer rotor 1 and the inner rotor 2. On the other hand, in a case where volumes of the respective advanced angle chambers 43 are increased when the operation oil is supplied thereto, the vanes 5 are displaced towards the respective retarded angle chambers 42 (in an advanced angle direction S2) so as to form the advanced angle phase between the outer rotor 1 and the inner rotor 2. Accordingly, a rotational phase of the camshaft 3 relative to a rotational phase of the crankshaft is changed, thereby achieving a control of an opening-and-closing timing of the air intake valve or the exhaust valve.

The camshaft 3 is arranged so that an axis thereof corresponds to the relative rotational axis X. Furthermore, the camshaft 3 is connected to the inner rotor 2. The inner rotor 2 is fitted into the outer rotor 1 so as to be coaxial and so as to be rotatable within a predetermined range of relative rotational phase. The front plate 22 is provided at one surface of the outer rotor 1 and the rear plate 23 is provided at the other surface of the outer rotor 1. More specifically, the front plate 22 and the rear plate 23 are fixed at the outer rotor 1 by means of bolts 25 so as to be coaxial with the outer rotor 1. Accordingly, the inner rotor 2 is sandwiched by the front plate 22 and the rear plate 23.

A timing sprocket 20 is integrally formed at an outer circumferential surface of the rear plate 23. A power transmission member 24, such as a timing chain, a timing belt or the like, is provided between the timing sprocket 20 and a gear attached at the crankshaft of the engine.

While the engine is operated, a rotational driving force, which is generated by the engine and is outputted to the crankshaft, is transmitted to the timing sprocket 20 via the power transmission member 24. Accordingly, the outer rotor 1 is driven to rotate in a rotational direction S indicated in, for example, FIG. 2. In response to the rotation of the outer rotor 1, the inner rotor 2 rotates in the rotational direction S, thereby rotating the camshaft 3. As a result, a cam provided at the camshaft 3 is driven to rotate, thereby performing an opening-and-closing operation of the air intake valve or the exhaust valve of the engine.

An engine oil is used as the operation oil (i.e. the operation fluid) in this embodiment. The valve timing control apparatus of this embodiment further includes a lock mechanism 6 for locking the relative rotational phase formed between the outer rotor 1 and the inner rotor 2 at a lock phase (i.e. an intermediate lock phase), which is set between a most retarded angle phase and a most advanced angle phase. The lock phase is also referred to as a predetermined phase in this disclosure. The lock mechanism 6 retains (locks) the outer rotor 1 and the inner rotor 2 at a set relative rotational position while a pressure of the operation oil is not stabilized immediately after the engine is started, so that the rotational phase of the camshaft 3 relative to the rotational phase of the crankshaft is properly retained in order to achieve a stable rotation of the engine.

The valve timing control apparatus of this embodiment further includes a crank angle sensor for detecting a rotational angle of the crankshaft of the engine and a camshaft angle sensor for detecting a rotational angle of the camshaft 3. An electronic control unit 9 (which will be hereinafter referred to as an ECU 9) for controlling the valve timing control apparatus of this embodiment detects the relative rotational phase formed between the outer rotor 1 and the inner rotor 2 on the basis of detection results of the crank angle sensor and the camshaft angle sensor in order to determine whether the relative rotational phase formed between the outer rotor 1 and the inner rotor 2 is the advanced angle phase or the retarded angle phase relative to the lock phase.

The ECU 9 includes a signal system for obtaining information relating to an ON/OFF state of an ignition key, information outputted from an oil temperature sensor for detecting an oil temperature of the engine oil, and the like. Furthermore, the ECU 9 includes a memory within which a control information of an optimal (i.e. the most appropriate, the most suitable) relative rotational phase in response to an operation state of the engine is memorized. The ECU 9 controls the relative rotational phase formed between the outer rotor 1 and the inner rotor 2 on the basis of the information relative to the operation state (e.g. a rotation number of the engine (an engine speed), a coolant temperature and the like) and the control information.

A configuration of the valve timing control apparatus according to the first embodiment will be described in more detail.

[Fluid Pressure Chamber]

As illustrated in FIG. 2, plural protruding portions 4, each of which serves as a shoe inwardly extending in a radial direction of the outer rotor 1, are formed at the outer rotor 1 along the rotational direction S while keeping a distance therebetween. The inner rotor 2 is fitted into the outer rotor 1 in a state where the outer circumferential surface of the inner rotor 2 contacts inner circumferential surfaces of plural protruding portions 4. Each of the fluid pressure chambers 40 is defined by the neighboring protruding portions 4.

Vane grooves 41 are formed at an outer circumferential portion of the inner rotor 2, facing the fluid pressure chambers 40, so as to open towards the fluid pressure chambers 40, respectively. The vanes 5 having a plate shape are inserted into and fixed within the respective vane grooves 41. More specifically, each of the vanes 5 is arranged so as to be slidable along the radially outer circumferential surface of each of the fluid pressure chambers 40, an inner surface of the front plate 22 and an inner surface of the rear plate 23. As described above, each of the vanes 5 is arranged at a position where the vane 5 divides the corresponding fluid pressure chamber 40 into the advanced angle chamber 43 and the retarded angle chamber 42 in the relative rotational direction S (i.e. in directions indicated by arrows S1 and S2 in FIG. 2).

Advanced angle passages 11 are formed at the inner rotor 2 so as to be in communication with the advanced angle chambers 43, respectively. Retarded angle passages 10 are formed at the inner rotor 2 so as to be in communication with the retarded angle chambers 42, respectively. As illustrated in FIG. 1, the retarded angle passages 10 and the advanced angle passages 11 are connected to a hydraulic circuit 7, which is further connected to an oil pan 75 of the engine.

In the valve timing control apparatus according to the first embodiment, clearances are formed between the inner rotor 2 on the one hand and the front plate 22 and the rear plate 23 on the other, so that the operation oil slightly leaks from the clearances. Furthermore, the operation oil slightly leaks from the valve timing control apparatus via other clearances formed at the valve timing control apparatus. The operation oil leaked from the valve timing control apparatus is collected by the oil pan 75.

[Hydraulic Circuit]

The hydraulic circuit 7 is actuated by the driving force generated by the engine. More specifically, as illustrated in FIG. 1, the hydraulic circuit 7 includes a hydraulic pump 70 for discharging the engine oil as the operation oil and an electromagnetically controlled-type oil control valve 176, which will be herein after referred to as an OCV 176 (an example of an operation fluid supply-and-discharge mechanism). The OCV 176 serves as a phase control valve, and also as a lock control valve. A predetermined port of the OCV 176 is connected to the retarded angle passages 10, the advanced angle passages 11 and a lock piece operating oil passage 63, which is connected to lock recessed portions 162A and 162B serving as an engagement groove. The OCV 176 is controlled by the ECU 9.

The ECU 9 controls the OCV 176 in order to control the operation oil to be supplied to the retarded angle chambers 42, the advanced angle chambers 43 and the lock recessed portions 162A and 162B via the retarded angle passages 10, the advanced angle passages 11 and the lock piece operating oil passage 63, respectively. Accordingly, the relative phase formed between the outer rotor 1 and the inner rotor 2 is controlled between the most advanced angle phase (i.e. a relative rotational phase by which the volume of each of the advanced angle chambers 43 becomes maximum) and the most retarded angle phase (i.e. a relative rotational phase by which the volume of each of the retarded angle chambers 42 becomes maximum), and the lock piece is actuated in an unlocking direction. The detailed explanation about an operation of the OCV 176 is omitted here.

A spool-type valve is adapted as the OCV 176, so that an opening degree of the OCV 176 is adjusted on the basis of a duty ratio of an electricity supplied to an electromagnetic solenoid of the OCV 176. Accordingly, a supply/discharge amount of the operation oil is finely adjusted in response to the opening degree of the OCV 176.

[Torsion Spring]

As illustrated in FIG. 1, a torsion spring 8 is disposed between the inner rotor 2 and the front plate 22. The torsion spring 8 constantly biases the inner rotor 2 in a direction towards the advanced angle phase. More specifically, the torsion spring 8 biases the inner rotor 2 relative to the outer rotor 1 in the direction indicated by the arrow S2 in FIG. 2 (i.e. towards the advanced angle phase, in the advanced angle direction). Accordingly, a rotation of the inner rotor 2, which is rotated with the camshaft 3 as one unit, may be avoided from being delayed relative to a rotation of the outer rotor 1 because of a resistance generated by a valve spring and applied to the camshaft 3.

[Lock Mechanism]

Figure 8:
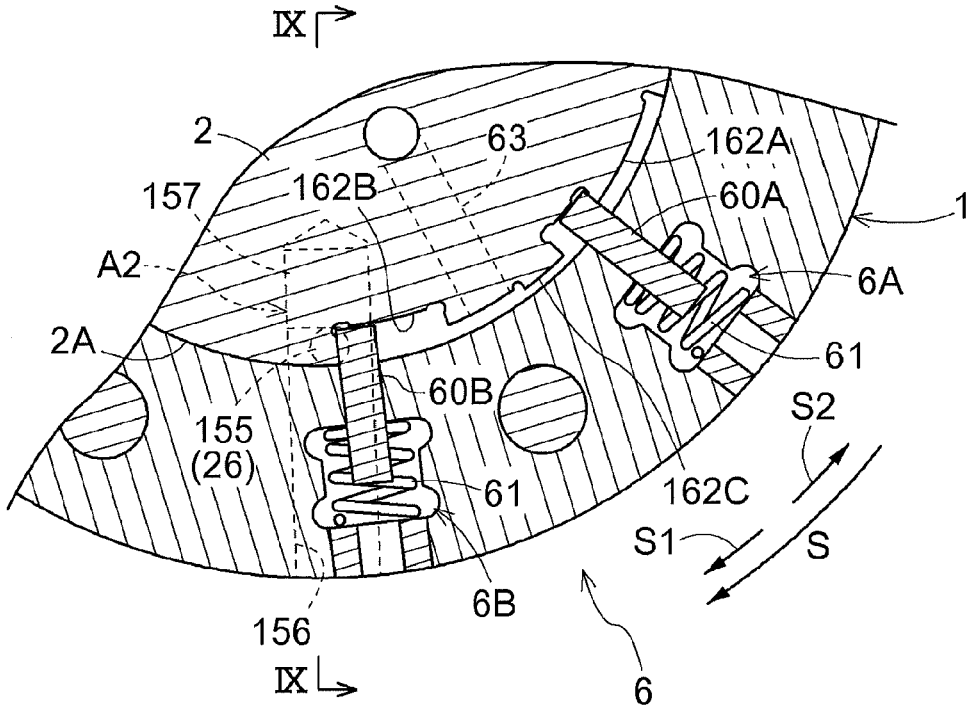
FIG. 8 is a partial cross-sectional diagram illustrating a relationship between a second air inlet mechanism and a lock mechanism in a case where the valve timing control apparatus is in the locked state.

As illustrated in FIGS. 2 and 8, the lock mechanism 6 includes a retarded angle lock portion 6A and an advanced angle lock portion 6B, which are provided at the outer rotor 1, and the lock recessed portions 162A and 162B, which serve as the engagement grooves and which are formed at a portion of an outer circumferential surface 2A of the inner rotor 2 sliding along the radially inner circumferential surface of the outer rotor 1. The retarded angle lock portion 6A includes a retarded angle piece 60A (an example of an engagement piece), which is formed in a plate shape and is supported at the outer rotor 1 so as to be slidably displaceable in the radial direction of the rotor 1, and a spring 61 for biasing the lock piece 60A so as to protrude in the lock recessed portion 162A. Similarly, the advanced angle lock portion 6B includes an advanced angle lock piece 60B, which is formed in a plate shape and is supported at the outer rotor 1 so as to be slidable displaceable in the radial direction of the rotor 1, and the spring 61 for biasing the lock piece 60B so as to protrude in the lock recessed portion 162B. In this embodiment, each of the lock pieces 60A and 60B is formed in the plate shape. However, each of the lock pieces 60A and 60B may be formed in a pin shape or the like.

The retarded angle lock portion 6A locks the rotation of the inner rotor 2 so as not to be rotated towards the retarded angle phase (i.e. in the direction indicated by S1 in FIG. 2) relative to the outer rotor 1 by the retarded angle lock piece 60A reaching the lock position and being engaged with the lock recessed portion 162A. Similarly, the advanced angle lock portion 6B locks the rotation of the inner rotor 2 so as not to be rotated towards the advanced angle phase (i.e. in the direction indicated by S2 in FIG. 2) relative to the outer rotor 1 by the advance angle lock piece 60B reaching the lock position and being engaged with the lock recessed portion 162B.

Accordingly, while the retarded angle lock portion 6A is engaged within the lock recessed portion 162A, changes in the relative rotational phase formed between the outer rotor 1 and the inner rotor 2 towards the retarded angle phase is restricted, but changes in the relative rotational phase towards the advanced angle phase is allowed. Similarly, while the advanced angle lock portion 6B is engaged within the lock recessed portion 162B, changes in the relative rotational phase formed between the outer rotor 1 and the inner rotor 2 towards the advanced angle phase are restricted, but changes in the relative rotational phase towards the retarded angle phase are allowed.

As illustrated in FIG. 2, both of the retarded angle lock piece 60A and the advanced angle lock piece 60B are engaged within the respective lock recessed portions 162A and 162B at the same time. Accordingly, the rotational phases (i.e. rotational angles) of the outer rotor 1 and the inner rotor 2 are locked at positions where the lock phase is formed, thereby turning the valve timing control apparatus in a locked state.

The lock recessed portion 162B is formed so as to be in communication with the lock piece operating oil passage 63, which is formed at the inner rotor 2. The lock piece operating oil passage 63 is connected to the predetermined port of the OCV 176 of the hydraulic circuit 7. The lock recessed portion 162A and the lock recessed portion 162B are connected to each other via a communication groove 162C, which is formed at a portion of the outer circumferential surface of the inner rotor 2 so as to extend in a circumferential direction thereof. Accordingly, when the operation oil is supplied to the lock piece operating oil passage 63 from the OCV 176, the retarded angle lock piece 60A and the advanced angle lock piece 60B are pushed up (i.e. the retarded angle lock piece 60A and the advanced angle piece 60B are outwardly pushed in the radial direction of the inner rotor 2) so as to resist against biasing forces generated by the respective springs 61, thereby unlocking the relative rotation between the outer rotor 1 and the inner rotor 2. As a result, the relative rotation between the outer rotor 1 and the inner rotor 2 is allowed (see e.g. FIG. 4).

As illustrated in, for example, FIG. 2, the lock recessed portion 162A is formed so as to have a stepped portion in the circumferential direction of the inner rotor 2. More specifically, the lock recessed portion 162A is formed so that a depth thereof becomes shallow at an advanced angle chamber side (i.e. in the advanced angle direction) relative to the depth thereof at a retarded angle chamber side (i.e. the retarded angle direction). In other words, the lock recessed portion 162A is formed so that a portion thereof having the shallow depth extends along the circumferential surface of the inner rotor 2 in the advanced angle direction from the portion thereof having the deeper depth, which extends along the circumferential surface of the inner rotor 2 in the retarded angle direction. Similarly, the lock recessed portion 162B is also formed so that a depth thereof becomes shallow at the advanced angle chamber side relative to the depth thereof at the retarded angle chamber side. A length of the portion of the lock recessed portion 162A having the deeper depth in the circumferential direction is set to be shorter than a length of the portion of the lock recessed portion 162B having the deeper depth in the circumferential direction. Additionally, a length of the shallow portion of the lock recessed portion 162A in the circumferential direction is set to be longer than a length of the shallow portion of the lock recessed portion 162B.

Accordingly, a timing of the retarded angle lock piece 60A being engageably inserted into the shallow portion of the lock recessed portion 162A may be delayed relative to a timing of the advanced angle lock piece 60B being engageably inserted into the shallow portion of the lock recessed portion 162B. Furthermore, a timing of the retarded angle lock piece 60A being engageably inserted into the deeper portion of the lock recessed portion 162A may be delayed relative to a timing of the advanced angle lock piece 60B being engageably inserted into the deeper portion of the lock recessed portion 162B. Accordingly, the relative rotational phase may be changed to the lock phase (i.e. the outer rotor 1 and the inner rotor 2 are controlled to form the lock phase) while the relative rotational phase formed between the outer rotor 1 and the inner rotor 2 is gradually restricted within a predetermined range. As a result, the lock mechanism 6 surely locks the relative rotational phase formed between the outer rotor 1 and the inner rotor 2 at the lock phase.

[First Air Inlet Mechanism and Second Air Inlet Mechanism]

According to the valve timing control apparatus of the first embodiment, the control system is set at the ECU 9 so that the inner rotor 2 is rotated in a retarded angle direction relative to the outer rotor 1 in a case where the number of rotations of the engine (i.e. the rotational speed of the engine) is low and so that the inner rotor 2 is rotated in an advanced angle direction relative to the outer rotor 1 in a case where the number of rotations of the engine is high.

Accordingly, when the engine is stopped, the inner rotor 2 is rotated relative to the outer rotor 1 so as to be positioned at the retarded angle side relative to the lock phase (including the lock phase). In a case where the engine is started thereafter, the rotational phase (i.e. the rotational angle) of the inner rotor 2 relative to the outer rotor 1 is changed to the lock phase by the biasing force generated by the torsion spring 8 and the operation oil supplied to the advanced angle chambers 43 by means of the OCV 176 (see FIG. 2), so that the locked state is established by the lock mechanism 6 in order to start the engine.

On the other hand, in a case where the engine is stopped abnormally because a load applied thereto increases, the rotations of the outer rotor 1 and the inner rotor 2 are stopped while forming the most retarded angle phase (see FIG. 5) (i.e. the phase formed when the inner rotor 2 is rotated up to a point where the inner rotor 2 is rotated at maximum in the retarded angle direction). Generally, a region of phase covering the lock phase and the retarded angle phase (not including the lock phase) is referred to as an overly retarded angle region. In other words, the overly retarded angle region is also called an "Atkinson Cycle region". In a case where the engine is started while the relative rotational phase formed between the outer rotor 1 and the inner rotor 2 is within the overly retarded angle region, it may take time for the inner rotor 2 to be moved to a position where the lock phase is formed relative to the outer rotor 1. Accordingly, in this case, the engine is not smoothly started.

The above-mentioned phenomenon where it takes time to the rotational phase (i.e. the rotational angle) of the inner rotor 2 relative to the outer rotor 1 to reach the lock phase occurs under a condition where the operation oil remains within the retarded angle chambers 42. Specifically, for example, in a case where the engine is started after a relatively long time has passed since the engine is stopped in a cold region, more specifically, in a case where the operation oil is not smoothly discharged from the retarded angle chambers 42 because viscosity of the operation oil is high due to low temperature, not only does it take time to start the engine but also a power of a battery may be largely consumed.

Therefore, the valve timing control apparatus of the first embodiment includes a mechanism for discharging the operation oil remaining within the retarded angle chambers 42 via the OCV 176 in a case where the engine is stopped or where the electricity to the control system is interrupted. More specifically, the valve timing control apparatus of the first embodiment includes a first air inlet mechanism A1 and a second air inlet mechanism A2. In this embodiment, three of the first air inlet mechanisms A1 are provided at the valve timing control apparatus. Each of the first air inlet mechanisms A1 is configured so as to actively discharge the operation oil from the corresponding retarded angle chamber 42 by allowing air to flow into the retarded angle chamber 42 or to directly discharge the operation oil from the retarded angle chamber 42. The second air inlet mechanism A2 is configured so as to facilitate the discharge of the operation oil from the lock recessed portions 162A and 162B by allowing air to flow into the lock recessed portions 162A and 162B in order to surely insert the retarded angle lock piece 60A and the advanced angle lock piece 60B into the lock recessed portions 162A and 162B, respectively.

The detailed explanation about the mechanism for discharging the operation oil remaining within the retarded angle chambers 42 via the OCV 176 will be omitted here.

Figure 5:
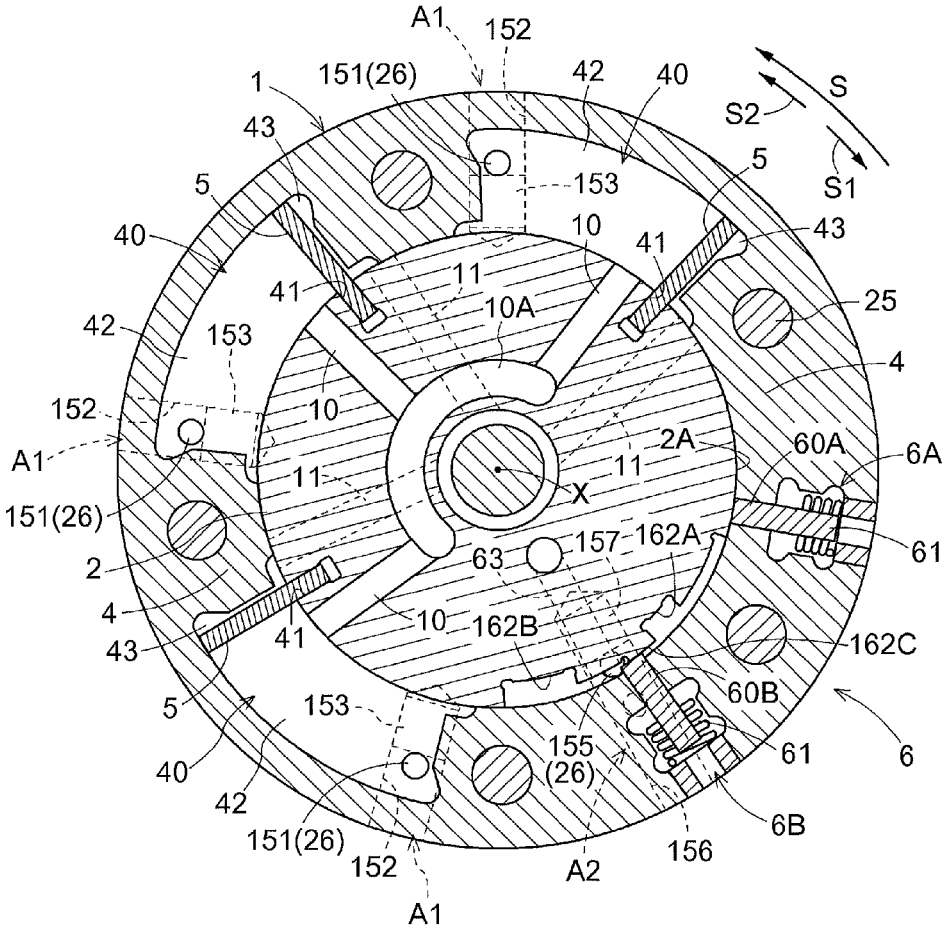
FIG. 5 is a cross-sectional diagram illustrating the valve timing control apparatus when a relative rotational phase falls within an overly retarded angle region.
Figure 6A:
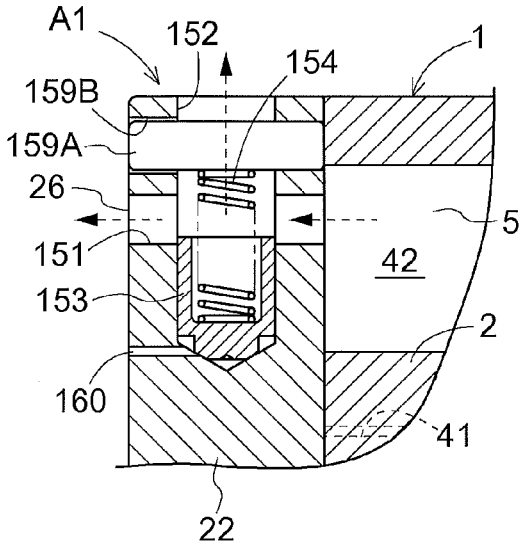
FIGS. 6A and 6B are cross-sectional diagrams illustrating an operation of a first air inlet mechanism.
Figure 6B:
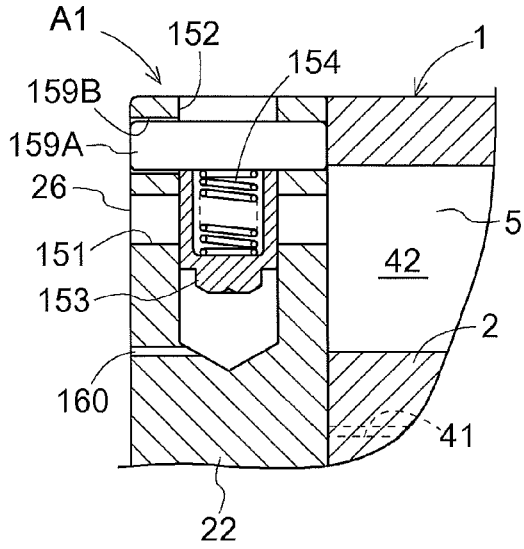
Figure 7:
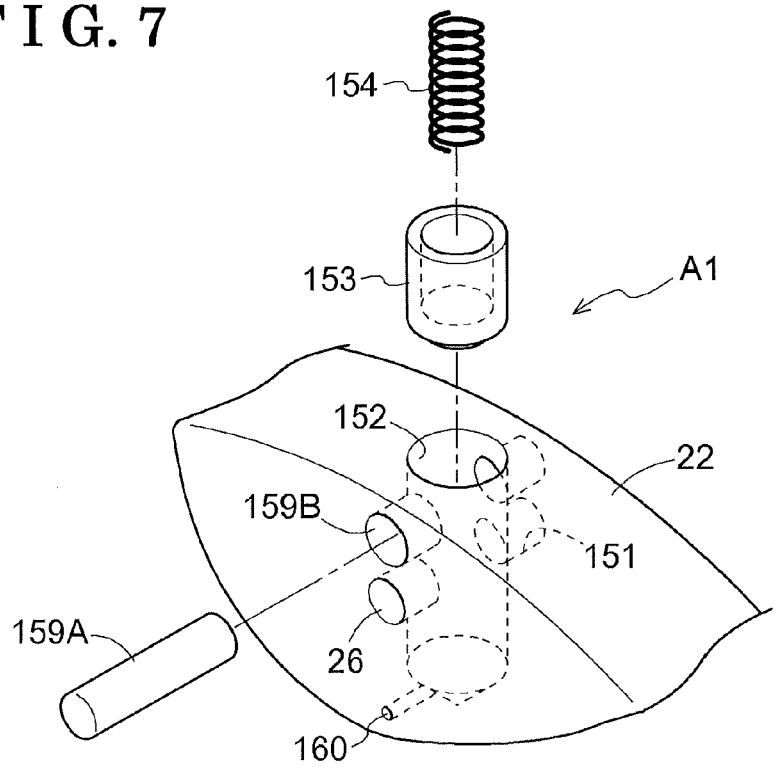
FIG. 7 is an exploded perspective view illustrating a configuration of the first air inlet mechanism.

As illustrated in FIG. 5, the first air inlet mechanisms A1 are provided at the front plate 22 so as to extend orthogonally to the relative rotational axis X at a most retarded angle side within the respective retarded angle chambers 42. In other words, the first air inlet mechanisms A1 are provided at end portions of the retarded angle chambers 42 in the advanced angle direction S2, respectively (i.e. in the vicinity of positions where the most advanced angle phase is formed when the vanes 5 are positioned thereat). More specifically, as illustrated in FIGS. 6A, 6B and 7, each of the first air inlet mechanisms A1 includes an atmosphere communication passage 151, a valve guiding bore 152, an on-off valve 153 and a spring 154, which serves as a biasing means. The atmosphere communication passage 151 is a straight bore that penetrates the front plate 22 and that extends along the relative rotational axis X. Furthermore, the atmosphere communication passage 151 connects an opening portion 26, which opens to an outer atmosphere, and the retarded angle chamber 42 when the valve timing control apparatus is assembled. The valve guiding bore 152 is a bore that radially-inwardly extends from the outer circumferential surface of the front plate 2 so as to be orthogonal to and intersect with the atmosphere communication passage 151. The on-off valve 153 is formed so as to correspond to an inner circumferential shape of the valve guiding bore 152 and so as to have a hollow shape having a bottom portion. Furthermore, the on-off valve 153 is provided within the valve guiding bore 152 so as to be slidable along an inner circumferential surface of the valve guiding bore 152 in the radial direction of the front plate 22. The spring 154 is provided within the hollow portion of the on-off valve 153 so as to inwardly bias the on-off valve 153 in the radial direction.

When the valve timing control apparatus is actuated, a centrifugal force, which is generated in response to a rotational speed of the outer rotor 1 (i.e. the front plate 22), acts on the on-off valves 153 of the respective first air inlet mechanisms A1. When the rotational speed of the outer rotor 1 increases and the centrifugal force becomes greater than biasing forces generated by the springs 154, the on-off valves 153 are outwardly displaced in the radial direction of the front plate 22 so as to resist against the biasing forces of the springs 154, respectively (see FIG. 6B). When each of the on-off valves 153 are positioned at a radially outermost position of the corresponding valve guiding bore 152, the corresponding atmosphere communication passage 151 is closed by an outer circumferential surface of the on-off valve 153. As a result, the communication between the opening portions 26 and the respective retarded angle chambers 42 is interrupted, so that air is not allowed to flow into the retarded angle chambers 42 and the operation oil remaining within the retarded angle chambers 42 is not discharged to an outside of the valve timing control apparatus from the opening portions 26. Additionally, an inner diameter of each of the valve guiding bores 152 (i.e. an outer diameter of each of the on-off valves 153) is set to be greater than an inner diameter of each of the atmosphere communication passages 151 in order to surely close each of the atmosphere communication passages 151 by means of each of the on-off valves 153.

A vent bore 160 is formed at an inner end portion of the valve guiding bore 152 of each of the first air inlet mechanisms A1 in the radial direction of the front plate 22, so that a clearance formed between a bottom portion of the valve guiding bore 152 and an end portion of the on-off valve 153 is normally opened to the outside of the valve timing control apparatus. Accordingly, the on-off valve 153 is smoothly operated when being moved in the radial direction without being influenced by an atmospheric pressure generated within the clearance formed between the bottom portion of the valve guiding bore 152 and the end portion of the on-off valve 153.

When the rotational speed of the outer rotor 1 decreases and the centrifugal force becomes lower than the biasing forces of the springs 154, the on-off valves 153 are inwardly displaced in the radial direction of the front plate 22 by the biasing forces of the respective springs 154. The atmosphere communication passages 151 are opened when the on-off valves 153 are positioned at a radially innermost position within the valve guiding bores 152, respectively. As a result, the opening portions 26 and the respective retarded angle chambers 42 become in communication with each other, thereby allowing air to flow into the retarded angle chambers 42, which may further allow the operation oil remaining within the retarded angle chambers 42 to be discharged to the outside of the valve timing control apparatus.

As illustrated in FIG. 7, a pin bore 159B is formed at a radially outer portion of the front plate 22 relative to each of the atmosphere communication passages 151 so as to be orthogonal to and intersect with each of the valve guiding bores 152 (see FIG. 7). A pin 159A is inserted into each of the pin bores 159B after the on-off valve 153 and the spring 154 are provided within the valve guiding bore 152, so that the on-off valve 153 and the spring 154 are not disengaged from the valve guiding bore 152. Accordingly, as illustrated in FIG. 6B, each of the on-off valves 153 is retained at a position where the on-off valve 153 contacts the pin 159B while the on-off valve 153 closes the atmosphere communication passage 151. Additionally, an inner diameter of the pin bore 159B is set to be smaller than an inner diameter of the valve guiding bore 152. Accordingly, as illustrated in FIG. 6A, while the on-off valves 153 are positioned at the radially inner portion within the valve guiding bores 152 so as to open the atmosphere communication passages 151, respectively, the retarded angle chambers 42 are connected to the outside of the valve timing control apparatus via clearances formed between the valve guiding bores 152 and the pins 159A, respectively. As a result, more air is allowed to flow into the retarded angle chambers 42.

The front plate 22 is attached at the outer rotor 1 so that the atmosphere communication passages 151 are connected to the respective retarded angle chambers 42 in the vicinity of the end portion thereof in the advanced angle direction S2 (i.e. at the position where the most advanced angle phase is formed when the corresponding vanes 5 are positioned thereat). Accordingly, while the relative rotational phase formed between the outer rotor 1 and the inner rotor 2 is at least within a range between the most retarded angle phase and the lock phase including the most retarded angle phase and the predetermined phase, the first air inlet mechanisms A1 are in communication with the respective retarded angle chambers 42 in order to facilitate the discharge of the operation oil from the retarded angle chambers 42. However, the above-described arrangement of the first air inlet mechanisms A1 is only an example. The first air inlet mechanisms A1 may be formed at any desired position as long as the atmosphere communication passages 151 are in communication with the respective retarded angle chambers 42 while the relative rotational phase formed between the outer rotor 1 and the inner rotor 2 corresponds to the lock phase.

The expression, "the range between the most retarded angle phase and the lock phase", indicates that the most retarded angle phase and the lock phase are included in the range.

In the first embodiment, each of the first air inlet mechanisms A1 is configured so as to allow the air to inflow into each of the retarded angle chambers 42. However, the first air inlet mechanisms A1 may be modified so as to allow air to flow into the respective advanced angle chambers 43. Furthermore, in the first embodiment, plural first air inlet mechanisms A1 are formed so as to correspond to a number of retarded angle chambers 42. However, the valve timing control apparatus may be modified to include one or more of the first air inlet mechanisms A1 but less than the number of retarded angle chambers 42 (or the advanced angle chambers 43).

Figure 9:
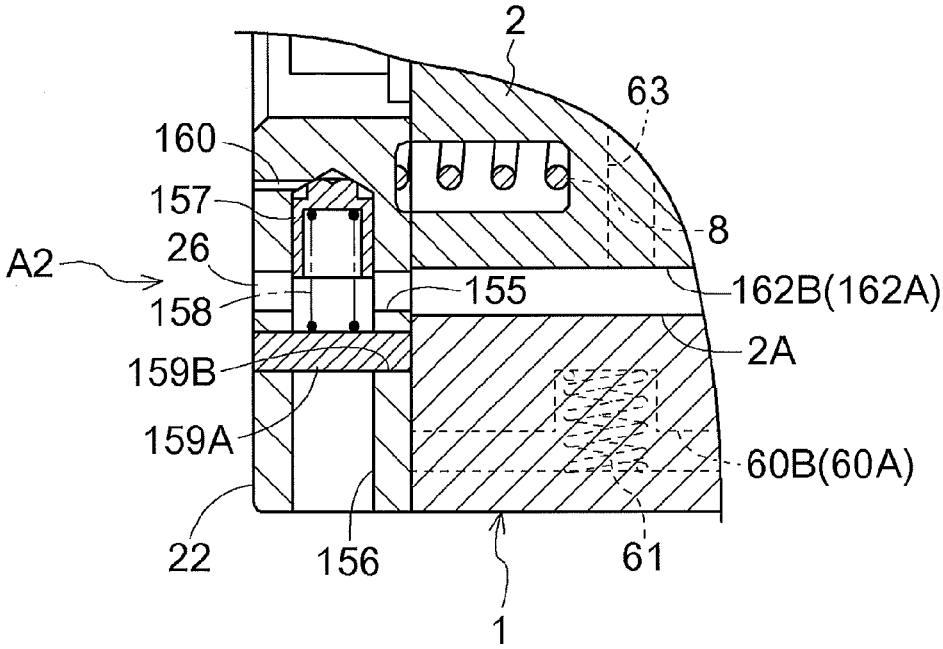
FIG. 9 is a cross-sectional diagram taken along line IX-IX in FIG. 8.

A basic configuration of the second air inlet mechanism A2 is similar to the first air inlet mechanism A1. More specifically, as illustrated in FIGS. 8 and 9, the second air inlet mechanism A2 includes an atmosphere communication passage 155, a valve guiding bore 156, an on-off valve 157 and a spring 158. The atmosphere communication passage 155 is formed at the front plate 22 so as to extend along the relative rotational axis X and so as to connect the opening portion 26 and the lock recessed portion 162B. The valve guiding bore 156 is formed so as to orthogonally intersect with the atmosphere communication passage 155. The on-off valve 157 is slidably provided within the valve guiding bore 156. The spring 158 inwardly biases the on-off valve 175 in the radial direction of the front plate 22. In the case where the rotational speed of the outer rotor 1 is high, the on-off valve 157 closes the atmosphere communication passage 155. On the other hand, in the case where the rotational speed of the outer rotor 1 is low, the on-off valve 157 opens the atmosphere communication passage 155, so that the lock recessed portion 162A and the lock recessed portion 162B are in communication with the opening portion 26 in order to allow air to flow to the lock recessed portions 162A and 162B.

However, the second air inlet mechanism A2 differs from the first air inlet mechanism A1 in that the atmosphere communication passage 155 of the second air inlet mechanism A2 is formed at the front plate 22 so that the atmosphere communication passage 155 becomes in communication with an end portion of the lock recessed portion 162B in the retarded angle direction S1 while the relative rotational phase formed between the outer rotor 1 and the inner rotor 2 corresponds to the lock phase (see FIG. 8). In other words, while the relative rotational phase formed between the outer rotor 1 and the inner rotor 2 is within the range between the most retarded angle phase and the lock phase, the atmosphere communication passage 155 becomes in communication with the lock recessed portion 162A (see FIGS. 3 and 5). On the other hand, in the case where the advanced angle phase is formed between the outer rotor 1 and the inner rotor 2, the lock recessed portion 162B is positioned so as to be displaced from the atmosphere communication passage 155 in the advanced angle direction S2, so that the atmosphere communication passage 155 does not communicate with the lock recessed portion 162A (see FIG. 4).

Accordingly, as illustrated in FIG. 5, in a case where the engine is stopped while the relative rotational phase formed between the outer rotor 1 and the inner rotor 2 is within the range between the most retarded angle phase and the lock phase, the rotational speed of the outer rotor 1 decreases because the engine is stopped. Accordingly, because the rotational speed of the outer rotor 1 is low, the on-off valves 153 of the first air inlet mechanisms A1 are positioned at the innermost positions within the valve guiding bores 152, respectively, so that the atmosphere communication passages 151 are opened to the outside of the valve timing control apparatus (see FIG. 6A). As a result, air is allowed to flow to the retarded angle chambers 42 via the opening portions 26, which are formed at the front plate 22, in order to facilitate the discharge of the operation oil remaining within the retarded angle chambers 42 by the OCV 176 and at the same time, in order to leak the operation oil remaining within the retarded angle chambers 42.

According to the first embodiment, because plural first air inlet mechanisms A1 are provided at the valve timing control apparatus, the valve timing control apparatus may be modified so that air flows from the atmosphere communication passage 151 of one of the air inlet mechanisms, which is positioned at an upper portion of the valve timing control apparatus, and the operation oil may be directly discharged to the outside of the valve timing control apparatus from the atmosphere communication passage 151 of the air inlet mechanism(s), which is (are) provided at a lower portion of the valve timing control apparatus. Furthermore, according to the first embodiment, an annular groove, which is connected to the OCV 176, is formed at the camshaft 3, and the retarded angle passage 10 is extended from the annular groove towards the inner rotor 2 along the relative rotational axis X (see FIGS. 1 to 5). More specifically, the retarded angle passage 10 is extended to and connected to an arc shaped dividing portion 10A, which is formed so as to surround the relative rotational axis X, at which the retarded angle passage 10 is divided into three so as to outwardly extend in the radial direction of the inner rotor 2. Accordingly, a length of a passage, through which the air flowing to the retarded angle chamber 42 from the atmosphere communication passage 151 of the first air inlet mechanism positioned at the upper portion of the valve timing control apparatus flows towards the retarded angle chamber 42 having the first air inlet mechanism positioned at the lower portion at the valve timing apparatus via the retarded angle passage 10 at the upper position of the front plate 22, the divided portion 10A and then the retarded angle passage 10 at the lower position of the front plate 22, is formed to be shorter when comparing to a known valve timing control apparatus in which the retarded angle passage 10 is divided at the camshaft 3. In other words, because the dividing portion 10A is formed so as to across the inner rotor 2 and so as to connect each of the retarded angle passages 10 at the inner rotor 2, air flows within the valve timing control apparatus at a short distance, when comparing to the known valve timing control apparatus at which the dividing portion is formed at the camshaft (i.e. at which air flows back to camshaft before flows to the other retarded angle passage). Accordingly, the operation oil is quickly discharged from the retarded angle chambers 42.

As described above, when the rotational speed of the outer rotor 1 decreases, the on-off valve 157 of the second air inlet mechanism A2 reaches the radially innermost position within the valve guiding bore 156 by the biasing force generated by the spring 158, thereby opening the atmosphere communication passage 155. As a result, air is allowed to flow into the lock recessed portions 162A and 162B via the opening portion 26 in order to facilitate the discharge of the operation oil by the OCV 176 and at the same time, in order to leak the operation oil from the lock recessed portions 162A and 162B. Additionally, the operation oil within the lock recessed portions 162A and 162B may be directly discharged to the outside of the valve timing apparatus from the atmosphere communication passage 155.

As a result, in a case where the relative rotational phase formed between the outer rotor 1 and the inner rotor 2 is in the overly retarded angle region while the engine is stopped, the operation oil remaining within the retarded angle chambers 42 is actively discharged therefrom by allowing air to flow into the retarded angle chambers 42. Furthermore, when allowing air to flow into the lock recessed portions 162A and 162B, the operation oil therewithin is discharged to the outside of the valve timing control apparatus.

Accordingly, even in the case where the relative rotational phase formed between the outer rotor 1 and the inner rotor 2 is in the overly retarded angle region when the engine is stopped, the operation oil does not remain within the retarded angle chambers 42 because the operation oil within the retarded angle chambers 42 is actively discharged therefrom immediately after the engine is stopped. Therefore, even in a case where the engine is started again after time has passed since the engine had stopped, the relative rotational phase (i.e. the rotational angle) of the inner rotor 2 relative to the outer rotor 1 is quickly changed to the lock phase, so that the valve timing control apparatus is smoothly locked by the lock mechanism 6 at an early stage. As a result, the engine is appropriately started.

Second Embodiment

Figure 10:
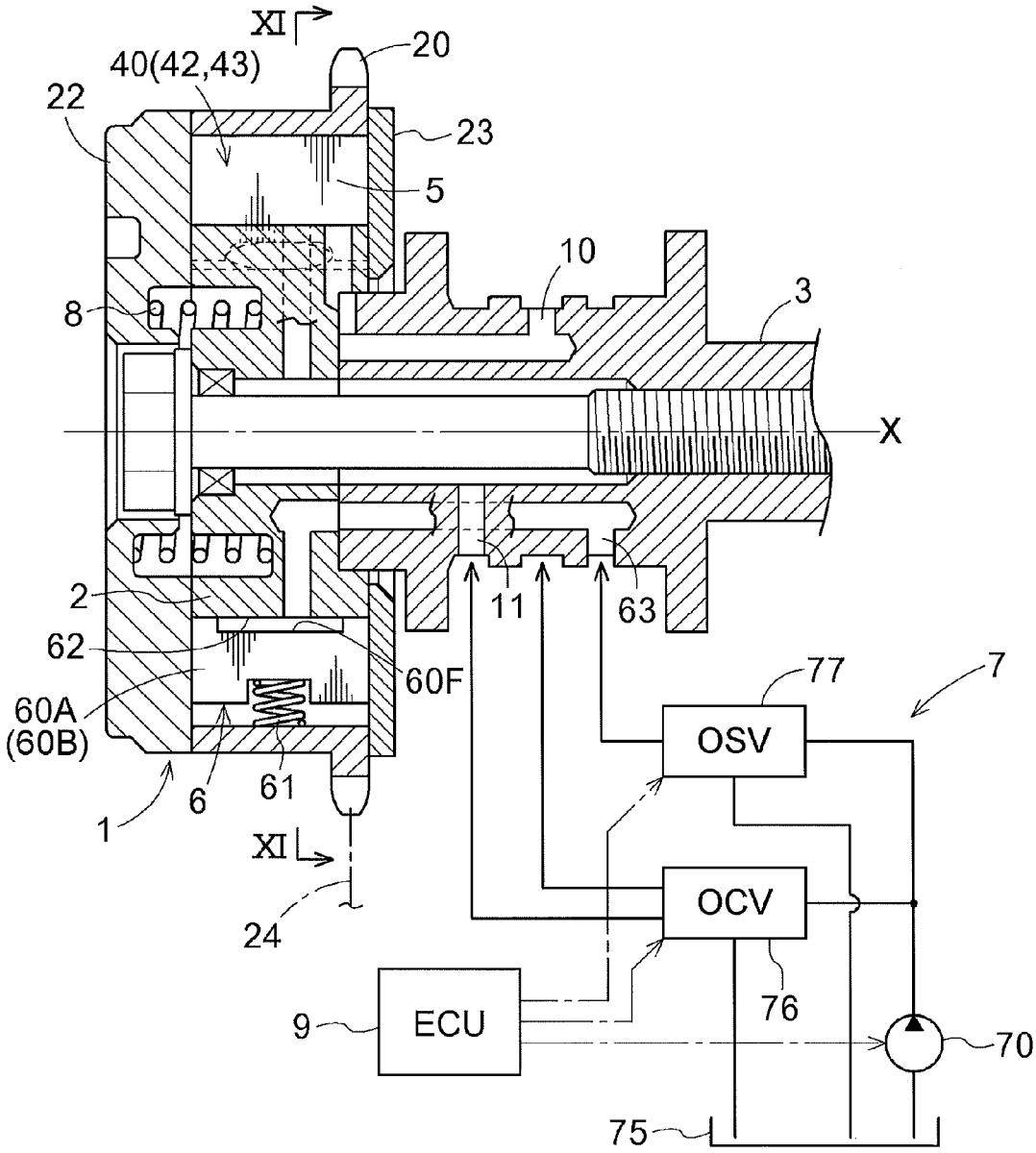
FIG. 10 is a diagram illustrating an entire configuration of a valve timing control apparatus according to a second embodiment.
Figure 11:
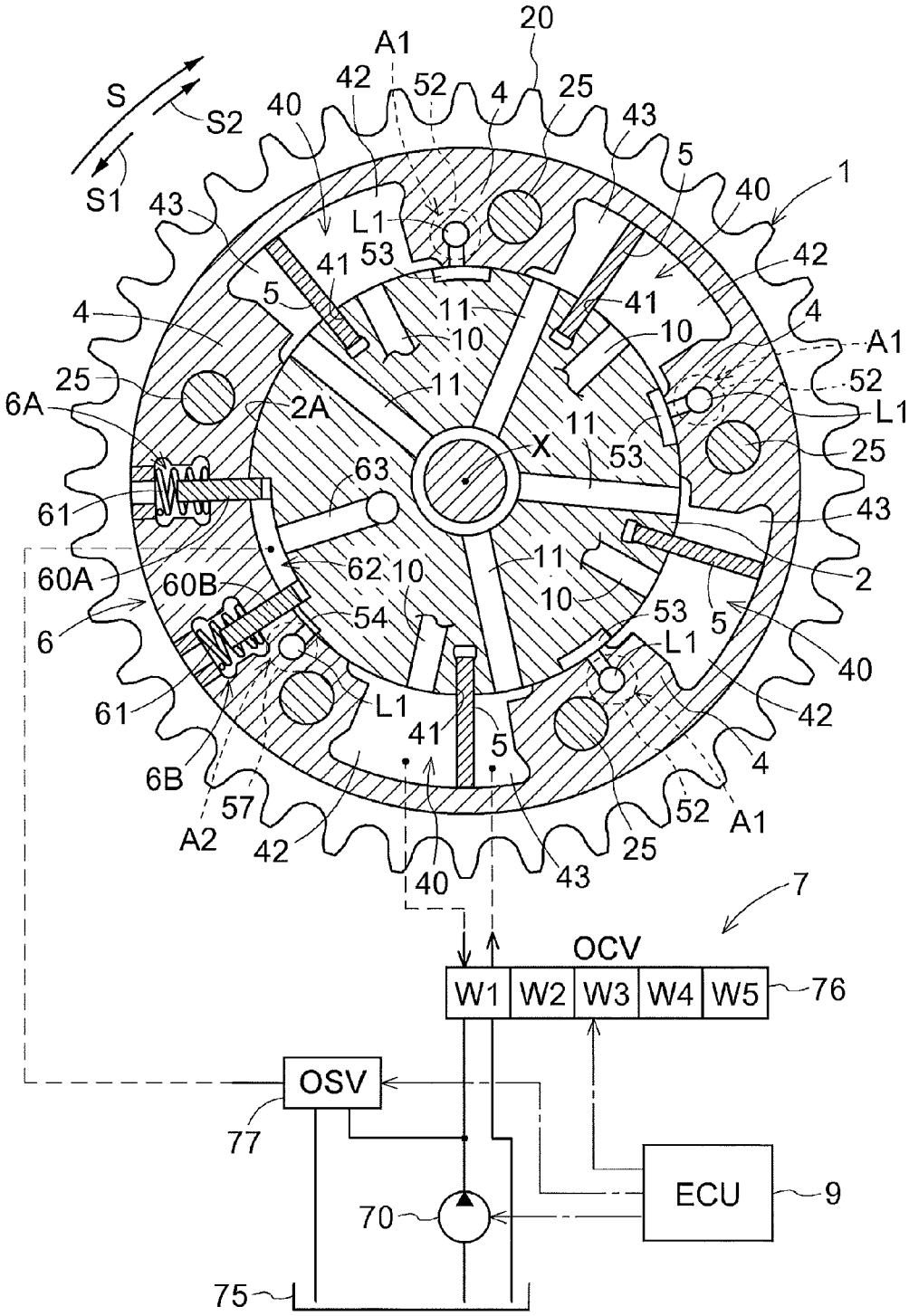
FIG. 11 is a cross-sectional diagram taken along line XI-XI in FIG. 10 including a hydraulic circuit system.
Figure 13:
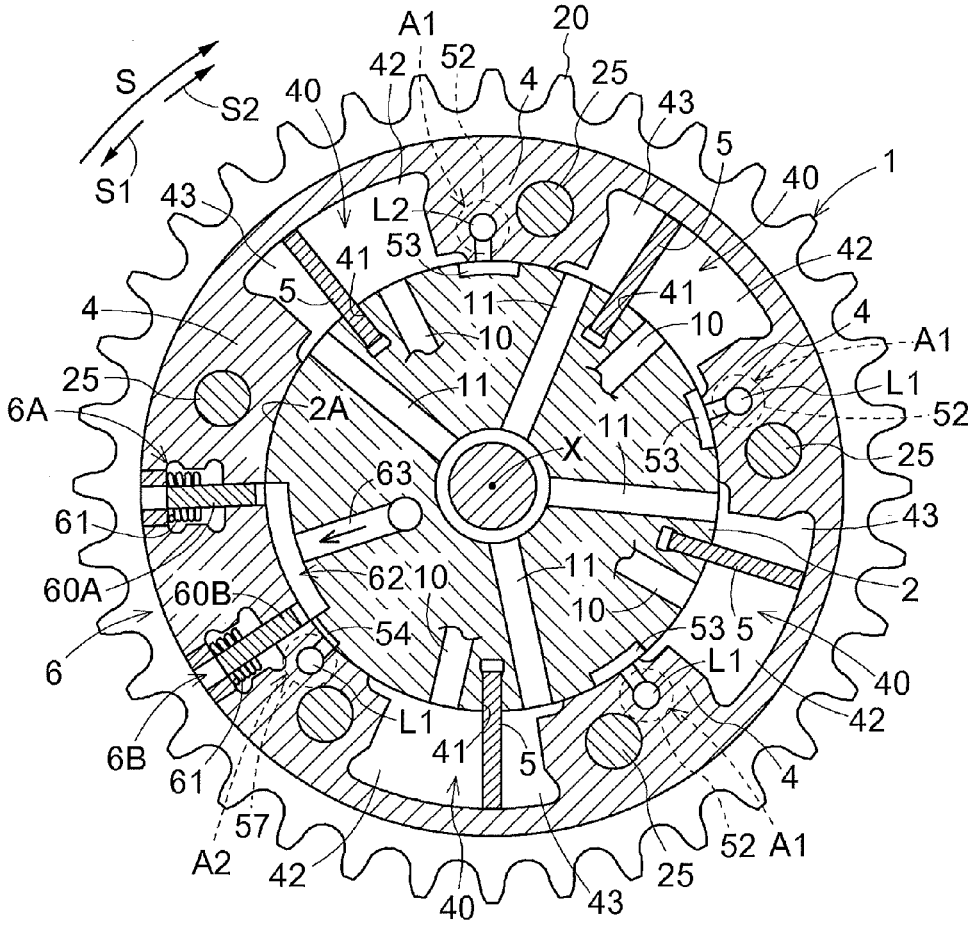
FIG. 13 is a cross-sectional diagram illustrating a valve timing control apparatus according to the second embodiment in a case where the valve timing control apparatus is actuated.
Figure 14:
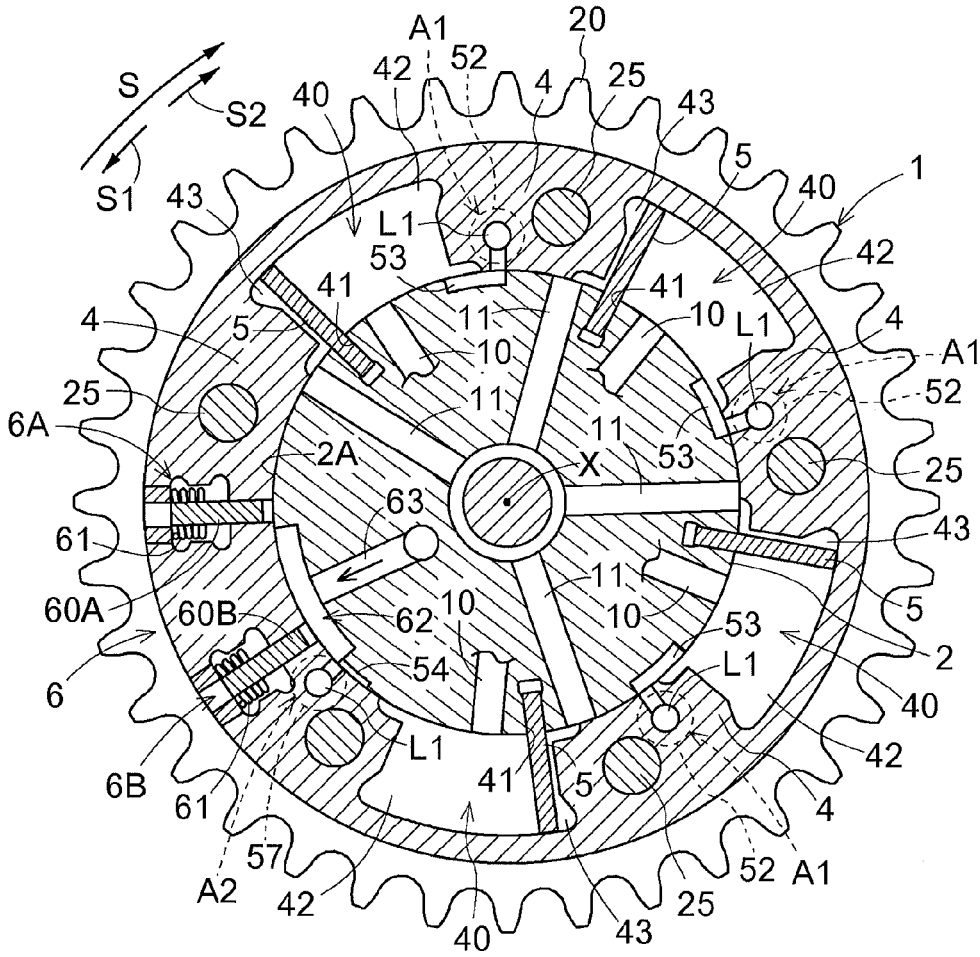
FIG. 14 is a cross-sectional diagram illustrating the valve timing control apparatus according to the second embodiment in a case where a relative rotational phase falls within an overly retarded angle region.

A second embodiment of a valve timing control apparatus will be described below with reference to FIGS. 10 to 16 of the attached drawings. An explanation of a configuration of the valve timing control apparatus similar to the first embodiment, more specifically, the entire configuration of the valve timing control apparatus and the fluid pressure chambers, the torsion spring will be omitted here. Therefore, only the differences between the first embodiment and the second embodiment will be described below. Furthermore, substantially identical elements in the second embodiment are identified with identical reference numbers and symbols as the first embodiment. Illustrated in FIG. 10 is a cross-sectional diagram illustrating the entire configuration of the valve timing control apparatus according to the second embodiment when being viewed in a direction orthogonal to the relative rotational axis X. Illustrated in FIG. 11 is a diagram illustrating a combination of the valve timing control apparatus and the hydraulic system. Illustrated in FIGS. 13 and 14 are cross-sectional diagrams of the valve timing control apparatus when being operated.

[Hydraulic Circuit]

The hydraulic circuit 7 is actuated by the driving force generated by the engine. More specifically, as illustrated in FIG. 10, the hydraulic circuit 7 includes the hydraulic pressure pump 70 for discharging the engine oil as the operation oil, an electromagnetically controlled-type OCV 76 (an example of the operation fluid supply supply-and-discharge mechanism), which serves as a phase control valve, and an electromagnetically controlled-type oil switching valve 77 (which will be hereinafter referred to as an OSV 77), which serves as a lock control valve. A predetermined port of the OCV 76 is connected to the retarded angle passages 10 and the advanced angle passages 11. On the other hand, a predetermined port of the OSV 77 (an example of the operation fluid supply-and-discharge mechanism) is connected to the lock piece operating oil passage 63, which is connected to a lock recessed portion 62 serving as an engagement groove. The OCV 76 and the OSV 77 are controlled by the ECU 9.

The ECU 9 controls the OCV 76 in order to control the operation oil to be supplied to the retarded angle chambers 42 and the advanced angle chambers 43 via the retarded angle passages 10 and the advanced angle passages 11, respectively. Accordingly, the relative phase formed between the outer rotor 1 and the inner rotor 2 is controlled between the most advanced angle phase (i.e. the relative rotational phase by which the volume of each of the advanced angle chambers 43 becomes maximum) and the most retarded angle phase (i.e. the relative rotational phase by which the volume of each of the retarded angle chambers 42 becomes maximum).

A spool-type valve is adapted as the OCV 76, so that the OCV 76 is switched to either a first state W1, a second state W2, a third state W3, a fourth state W4 or a fifth state W5. The first state W1 is a state where the operation oil is supplied to the advanced angle chambers 43 and the operation oil is discharged from the retarded angle chambers 42. The second state W2 is a state where the operation oil is supplied to the advanced angle chambers 43 and the retarded angle passages 10 are closed. The third state W3 is a state where both of the retarded angle passages 10 and the advanced angle passages 11 are closed, so that the operation oil is not supplied or discharged to/from the retarded angle chambers 42 and the advanced angle chambers 43. The fourth state W4 is a state where the advanced angle passages 11 are closed and the operation oil is supplied to the retarded angle chambers 42. Furthermore, the fifth state W5 is a state where the operation oil is discharged from the advanced angle chambers 43 and the operation oil is supplied to the retarded angle chambers 42.

An opening degree of the OCV 76 is adjusted on the basis of a duty ratio of an electricity supplied to an electromagnetic solenoid of the OCV 76. Accordingly, a supply/discharge amount of the operation oil is finely adjusted in response to the opening degree of the OCV 76.

The ECU 9 controls the OSV 77 in order to actuate the lock pieces in the unlocking direction. In other words, the lock mechanism 6 locks the relative rotational phase formed between the outer rotor 1 and the inner rotor 2 at the lock phase, by which the engine is appropriately started.

[Lock Mechanism]

Figure 12:
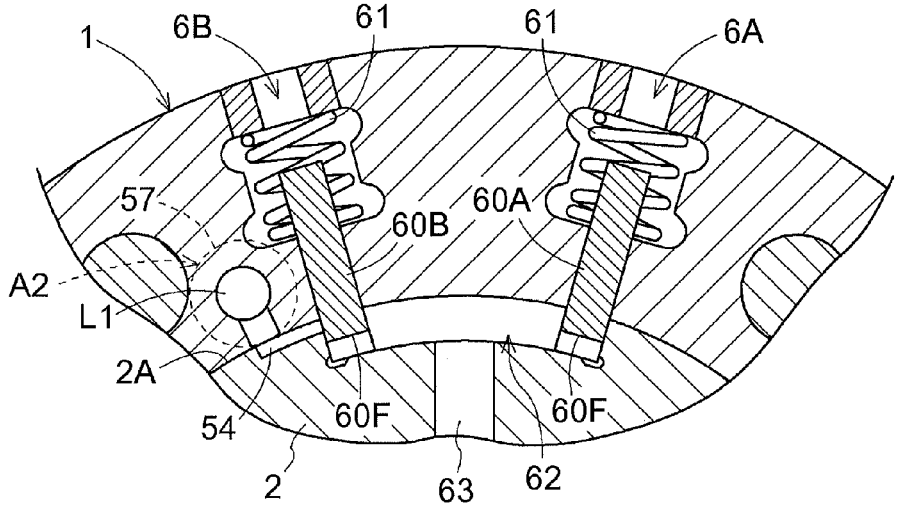
FIG. 12 is an enlarged cross-sectional diagram illustrating a portion of a lock mechanism according to the second embodiment.

As illustrated in FIGS. 11 and 12, the lock mechanism 6 includes the retarded angle lock portion 6A, the advanced angle lock portion 6B, which are provided at the outer rotor 1, and the lock recessed portion 62, which serves as the engagement grooves and which is formed at a portion of the outer circumferential surface 2A of the inner rotor 2 sliding along the radially inner circumferential surface of the outer rotor 1. The retarded angle lock portion 6A includes the retarded angle piece 60A (an example of the engagement piece), which is formed in the plate shape and is supported at the outer rotor 1 so as to be slidably displaceable in the radial direction of the rotor 1, and the spring 61 for biasing the lock piece 60A so as to protrude in the lock recessed portion 62. Similarly, the advanced angle lock portion 6B includes the advanced angle lock piece 60B, which is formed in the plate shape and is supported at the outer rotor 1 so as to be slidable displaceable in the radial direction of the rotor 1, and the spring 61 for biasing the lock piece 60B so as to protrude in the lock recessed portion 62. In this embodiment, each of the lock pieces 60A and 60B is formed in the plate shape. However, each of the lock pieces 60A and 60B may be formed in a pin shape or the like.

The retarded angle lock portion 6A locks the rotation of the inner rotor 2 so as not to be rotated towards the retarded angle phase (i.e. in the direction indicated by S1 in FIG. 2) relative to the outer rotor 1 in a manner where the retarded angle lock piece 60A reaches the lock position and is engaged with the lock recessed portion 62. Similarly, the advanced angle lock portion 6B locks the rotation of the inner rotor 2 so as not to be rotated towards the advanced angle phase (i.e. in the direction indicated by S2 in FIG. 2) relative to the outer rotor 1 in a manner where the advance angle lock piece 60B reaches the lock position and is engaged with the lock recessed portion 62.

Accordingly, while the retarded angle lock portion 6A is engaged within the lock recessed portion 62, changes in the relative rotational phase formed between the outer rotor 1 and the inner rotor 2 towards the retarded angle phase is restricted, but changes in the relative rotational phase towards the advanced angle phase is allowed. Similarly, while the advanced angle lock portion 6B is engaged within the lock recessed portion 62, changes in the relative rotational phase formed between the outer rotor 1 and the inner rotor 2 towards the advanced angle phase are restricted, but changes in the relative rotational phase towards the retarded angle phase are allowed.

As illustrated in FIGS. 11 and 12, both of the retarded angle lock piece 60A and the advanced angle lock piece 60B are engageably inserted into the lock recessed portion 62 at the same time. Accordingly, the rotational phases (i.e. the rotational angles) of the outer rotor 1 and the inner rotor 2 are locked at the lock phase, thereby turning the valve timing control apparatus in the locked state.

The lock recessed portion 62 is formed so as to be in communication with the lock piece operating oil passage 63, which is formed at the inner rotor 2. The lock piece operating oil passage 63 is connected to the predetermined port of the OSV 77 of the hydraulic circuit 7. A cut-out is formed at an end portion of each of the retarded angle piece 60A and the advanced angle piece 60B inwardly protruding into the lock recessed portion 62. A bottom surface of the cut-out, which faces the relative rotational axis X, serves as an operated surface 60F. Accordingly, when the operation oil is supplied to the lock recessed portion 63 via the OSV 77, a hydraulic pressure is applied to the operated surfaces 60F of the cut-outs of the respective retarded angle lock piece 60A and the advanced angle lock piece 60B, so that the retarded angle lock piece 60A and the advanced angle lock piece 60A are pushed up (i.e. outwardly pushed in the radial direction) so as to resist against the biasing force generated by the respective springs 61. Accordingly, the lock state is cancelled and the outer rotor 1 and the inner rotor 2 are allowed to rotate relative to each other.

[First Air Inlet Mechanism and Second Air Inlet Mechanism]

According to the second embodiment, the valve timing control apparatus includes a mechanism for discharging the operation oil remaining within the retarded angle chambers 42 via the OCV 76 in a state where the engine is stopped or where the electricity to the control system is interrupted. More specifically, the valve timing control apparatus of the second embodiment includes the first air inlet mechanism A1 and the second air inlet mechanism A2. In this embodiment, three of the first air inlet mechanisms A1 are provided at the valve timing control apparatus. Each of the first air inlet mechanisms A1 is configured so as to actively discharge the operation oil from the corresponding retarded angle chamber 42 by allowing air to flow thereinto or to directly discharge the operation oil therefrom. The second air inlet mechanism A2 is configured so as to facilitate the discharge of the operation oil from the lock recessed portion 62 (an example of the engagement groove), into which the lock pieces 60A and 60B are inserted, by allowing air to flow into the lock recessed portion 62 in order to surely insert the retarded angle lock piece 60A and the advanced angle lock piece 60B into the lock recessed portion 62.

A mechanism for discharging the operation oil remaining within the retarded angle chambers 42 via the OCV 76 includes a spring for actuating a spool of the OCV 76 to be at the first state W1, and the like while the OCV 76 is not controlled. When the OCV 76 is turned to be in the first state W1, the operation oil is discharged from the retarded angle chambers 42 to the oil pan 75.

Alternatively, the mechanism for discharging the operation oil remaining within the retarded angle chambers 42 may be configured with a valve for discharging the operation oil while the engine is stopped, in addition to the OCV 76, so that the operation oil is discharged from the retarded angle chambers 42 and the advanced angle chambers 43 while the engine is stopped.

Figure 15:
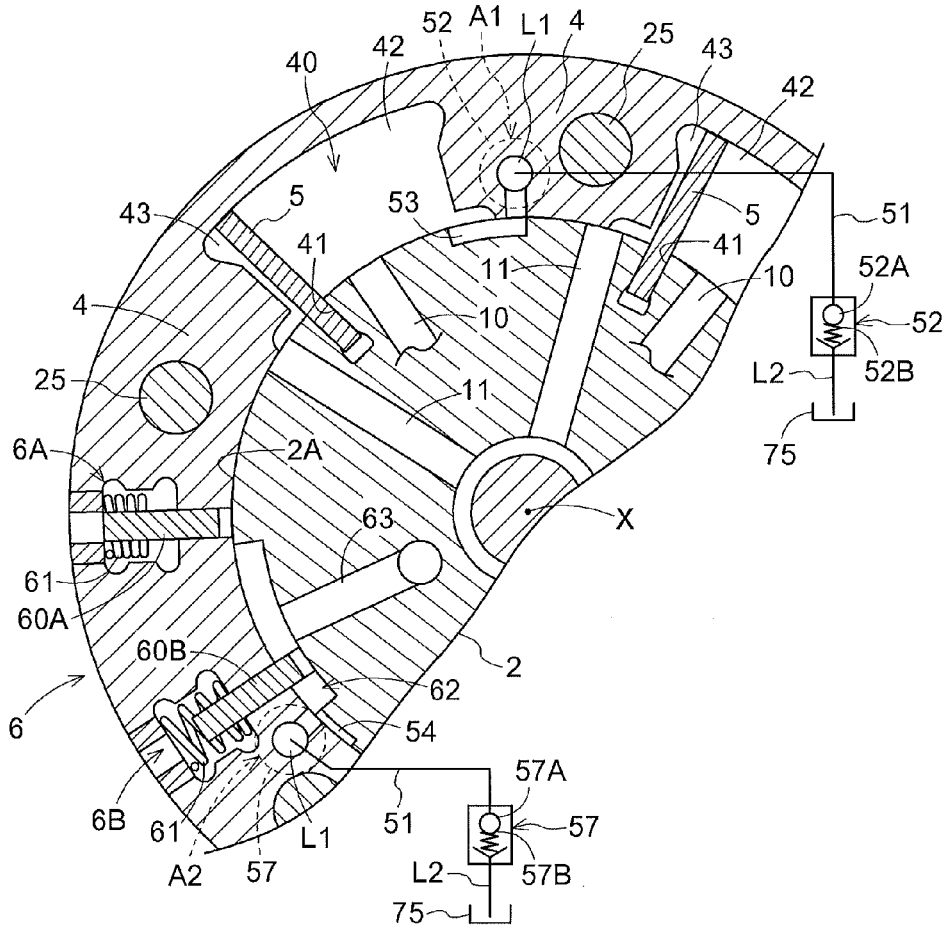
FIG. 15 is a diagram schematically illustrating an arrangement of a check valve according to the second embodiment.
Figure 16:
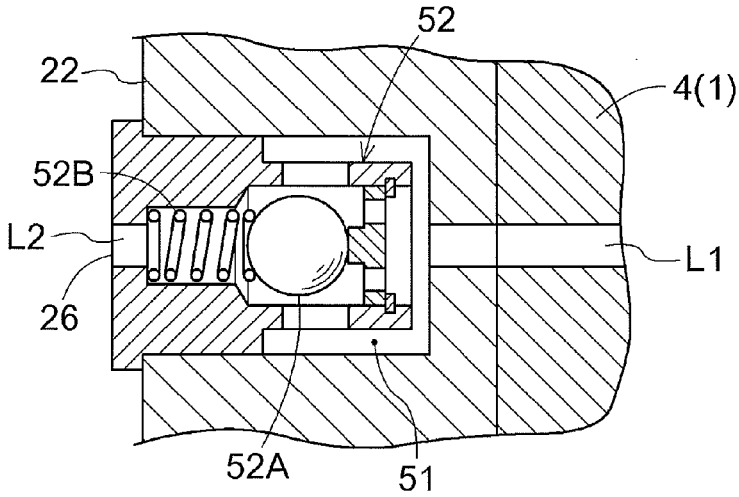
FIG. 16 is a cross-sectional diagram illustrating a configuration of the check valve.

As illustrated in FIGS. 15 and 16, each of the first air inlet mechanisms A1 includes a communication space 51, which is formed at the front plate 22 as a mechanical space, a check valve 52 and a communication passage 53. The check valve 52 includes a ball 52A provided within the communication space 51 and a spring 52B serving as a biasing means. The communication passage 53 is formed in a groove shape at the outer circumferential surface of the inner rotor 2 so as to allow air to flow into the corresponding retarded angle chamber 42 while the relative rotational phase formed between the outer rotor 1 and the inner rotor 2 is within the range between the most retarded angle phase and the lock phase (including the most retarded angle phase and the lock phase). Alternatively, each of the first air inlet mechanisms A1 may be configured so as to allow air to flow into the corresponding retarded angle chamber 42 only in a case where the relative rotational phase formed between the outer rotor 1 and the inner rotor 2 is in the overly retarded angle region (including the most retarded angle phase but not including the lock phase).

The ball 52A of the check valve 52, which is included in each of the first air inlet mechanisms A1, is arranged at an intermediate position between a first communication port L1, which is connected to the corresponding retarded angle chamber 42, and a second communication port L2, which is connected to the opening portion 26. The ball 52A interrupts and establishes a communication between the first and second communication ports L1 and L2. Additionally, the communication space 51 is formed at a portion of the outer rotor 1 so as to be in the vicinity of the corresponding retarded angle chamber 42, so that air flows into the retarded angle chambers 42 at a short distance.

The first air inlet mechanisms A1 allow air to flow into the respective retarded angle chambers 42. However, the first air inlet mechanisms A1 may be modified so as to allow air to flow into the respective advanced angle chambers 43. In this embodiment, a number of the first air inlet mechanisms A1 correspond to the number of retarded angle chambers 42. However, a number of the first air inlet mechanisms A1 less than the number of the retarded angle chambers 42 (or the advanced angle chambers 43) may be provided at the valve timing control apparatus. Additionally, each of the check valves 52 is configured so as to be in a closed state in a case where the pressure of the operation oil within the corresponding retarded angle chamber 42 is high, and in an opened state in a case where the pressure of the operation oil within the corresponding retarded angle chamber 42 becomes low.

The second air inlet mechanisms A2 includes a communication space 51, which is formed at the front plate 22, a check valve 57 and a communication passage 54. The check valve 57 includes a ball 57A and a spring 57B, which are provided within the communication space 51. The communication passage 54 is formed in a groove shape at the outer circumferential surface of the inner rotor 2 in order to allow air to flow into the lock recessed portion 62 while the relative rotational phase formed between the outer rotor 1 and the inner rotor 2 is within the range between the most retarded angle phase and the lock phase. The check valve 57 remains to be in a closed state in a case where the pressure of the operation oil within the lock recessed portion 62 is high. On the other hand, the check valve 75 is turned to be in an opened state in a case where the pressure of the operation oil within the lock recessed portion 62 becomes low in order to establish a communication between a first communication port L1, which is connected to the lock recessed portion 62, and a second communication port L2, which is connected to the opening portion 26, thereby allowing air to flow into the lock recessed portion 62. The check valve 72 has a similar configuration as the check valve 52 of each of the first air inlet mechanism A1. Alternatively, the second air inlet mechanism A2 may be configured so as to allow air to flow into the lock recessed portion 62 only in the case where the relative rotational phase formed between the outer rotor 1 and the inner rotor 2 is in the overly retarded angle region.

Accordingly, as illustrated in FIG. 14, in the case where the engine is stopped while the relative rotational phase formed between the outer rotor 1 and the inner rotor 2 is within the range between the most retarded angle phase and the lock phase, the retarded angle chambers 42 and the communication spaces 51 are in communication via the communication passages 53, respectively. In this case, the pressure of the operation oil acting on the retarded angle chambers 42 decreases because the engine is stopped. Accordingly, because the pressure of the operation oil acting on the retarded angle chambers 42 becomes low, each of the balls 52A of the respective check valves 52 reaches a position where the first communication port L1 and the second communication port L2 are allowed to be in communication with each other by the biasing force of the spring 52B, thereby opening the corresponding communication space 51 in order to allow air to flow into the corresponding retarded angle chamber 42 via the opening portion 26 of the front plate 22. As a result, the operation oil is discharged by the OCV 76 and at the same time, the operation oil is also leaked from the retarded angle chambers 42. More specifically, the operation oil within the retarded angle chambers 42 may be discharged therefrom to the outside of the valve timing control apparatus via openings of the front plate 22.

Furthermore, in the case where the engine is stopped while the relative rotational phase formed between the outer rotor 1 and the inner rotor 2 is within the range between the most retarded angle phase and the lock phase, the pressure of the operation oil remaining within the lock recessed portion 62 decreases because the engine is stopped. Accordingly, because the pressure of the operation oil within the lock recessed portion 62 becomes low, the ball 57A of the check valve 57 reaches a position where the first communication port L1 and the second communication port L2 are allowed to be in communication with each other by the biasing force of the spring 57B. As a result, air is allowed to flow into the lock recessed portion 62 from the outside of the front plate 22 in order to facilitate the discharge of the operation oil from the lock recessed portion 62 and at the same time, in order to leak the operation oil from the lock recessed portion 62. More specifically, the operation oil remaining within the lock recessed portion 62 may be discharged to the outside of the valve timing control apparatus via the openings of the front plate 22.

Other Embodiments

According to the above-described embodiments, in the case where the outer rotor 1 and the inner rotor 2 establish any relative rotational phase within the range between the most retarded angle phase and the lock phase, air flows into the retarded angle chambers 42 or advanced angle chambers 43 by the first air inlet mechanisms A1 and into the lock recessed portion by the second air inlet mechanism A2. However, the valve timing control apparatus of the embodiments may be modified as desired, as long as air is allowed to flow into the retarded angle chambers 42 or the advanced angle chamber 43 by the first air inlet mechanisms A1 and into the lock recessed portion (162A, 162B, 62) by the second air inlet mechanism A2 in the case where the relative rotational phase formed between the outer rotor 1 and the inner rotor 2 is within the range between the most retarded angle phase and the lock phase. For example, a certain range may be set within the range between the most retarded angle phase and the lock phase, so that air does not flow into the retarded angle chambers 42 or the advanced angle chambers 43 and into the lock recessed portion (162A, 162B, 62) while the relative rotational phase formed between the outer rotor 1 and the inner rotor 2 falls within the certain range.

According to the second embodiment, each of the check valves (52, 57) is configured to include the ball (52A, 57A) and the spring (52B, 57B). However, each of the check valves (52, 57) may be modified so as to include a resin board or the like, which is flexibly deformable, so that the resin board closes the oil passage in a case where the pressure of the operation oil is applied to the resin board, and so that the resin board is deformed to open the oil passage in a case where the pressure applied to the resin board becomes low.

Furthermore, in a case where a check valve including a ball or a poppet is used as each of the check valves (52, 57), the spring does not necessarily be included in the check valve.

The lock mechanism 6 may be modified so that the lock recessed portion (162A, 162B, 62: an example of the engagement groove) is formed at the outer rotor 1 (an example of the driving-side rotating body) and the lock piece(s) (60A, 60B: an example of the engagement piece) is (are) provided at the inner rotor 2 (an example of the driven-side rotating body).

The valve timing control apparatus of the embodiments may be adapted as a valve timing control apparatus of an internal combustion engine of an automobile and the like.

Accordingly, because the valve timing control apparatus of the embodiments includes the first air inlet mechanisms A1, air is allowed to flow into the retarded angle chambers 42 or into the advanced angle chambers 43. Therefore, for example, when the engine is stopped, the valve timing control apparatus of the embodiments facilitates the discharge of the operation oil, which remains within the retarded angle chambers 42 or the advanced angle chambers 43, therefrom. Accordingly, in a case where the engine is started again, the relative rotational phase formed between the outer rotor 1 and the inner rotor 2 may be promptly set at the lock phase.

According to the embodiments, the first air inlet mechanisms A1 allow air to flow into the retarded angle chambers 42 or into the advanced angle chambers 43 in the case where the rotational speed of the outer rotor 1 is low.

Accordingly, in the case where the rotational speed of the outer rotor 1 decreases, e.g. immediately after the engine is stopped abnormally and the like, air is allowed to flow into the retarded angle chambers 42 or into the advanced angle chambers 43 in order to facilitate the discharge of the operation oil therewithin. Therefore, even if the engine is re-started immediately after the engine is stopped, the inner rotor 2 is allowed to rotate relative to the outer rotor 1, so that the relative rotational phase formed between the outer rotor 1 and the inner rotor 2 may be promptly set at the lock phase.

According to the embodiments, the first air inlet mechanisms A1 are provided at the outer rotor 1 at the position where the first air inlet mechanisms A1 become in communication with the respective retarded angle chambers 42 while the relative rotational phase of the inner rotor 2 is at the lock phase.

In the case where the ambient temperature is low and the like, the engine may stall while a driving state of the engine is unstable (e.g. while the rotational speed of the engine is low). In the case where the rotational speed of the engine is low, the inner rotor is more likely to be rotated to the vicinity of a position where the outer rotor 1 and the inner rotor 2 establish the most retarded angle phase. In this case, the phase (i.e. the rotational angle) of the inner rotor 2 needs to be changed to a position where the lock phase is established relative to the outer rotor 1 in order to start the engine again. The lock phase is a phase formed between the outer rotor 1 and the inner rotor 2 within a range towards the advanced angle phase relative to the most retarded angle phase. However, under the cold temperature condition, the viscosity of the operation oil (i.e. the engine oil) is high. Therefore, the operation oil is likely to remain within the retarded angle chambers 42 or the advanced angle chambers 43. Generally, the relative rotational phase formed between the outer rotor 1 and the inner rotor 2 needs to be greatly rotated relative to each other in order to form the lock phase. However, a returning motion of the inner rotor (i.e. the rotation of the inner rotor 2 in the advanced angle direction S2) is disturbed because of the operation oil remaining within the retarded angle chambers 42. Accordingly, in a known valve timing control apparatus, the relative rotational phase formed between the outer rotor 1 and the inner rotor 2 is not promptly changed to the lock phase, which may result in deteriorating a re-startability of the engine.

On the other hand, according to the valve timing control apparatus of the embodiments, the first air inlet mechanisms A1 become in communication with the respective retarded angle chambers 42 at least while the relative rotational phase formed between the outer rotor 1 and the inner rotor 2 is within the range between the most retarded angle phase and the lock phase including the most retarded angle phase and the lock phase. Accordingly, in the case where the relative rotational phase formed between the outer rotor 1 and the inner rotor 2 is within the range between the most advanced angle phase and the lock phase including the most advanced angle phase and the lock phase, air is allowed to flow into the retarded angle chambers 42, so that the operation oil within the retarded angle chambers 42 is discharged therefrom. As a result, the operation resistance of the inner rotor 2 decreases, so that the relative rotational phase formed between the outer rotor 1 and the inner rotor 2 is promptly changed to the lock phase, which may further result in enhancing the re-startability of the engine.

According to the embodiments, each of the first air inlet mechanisms A1 includes the atmosphere communication passage 151 for connecting the opening portion 26, which opens to the outside of the valve timing control apparatus, with the corresponding retarded angle chamber 42 or the corresponding advanced angle chamber 43, the valve guiding bore 152 formed at the outer rotor 1 so as to extend in the radial direction thereof and so as to intersect with the atmosphere communication passage 151, and the on-off valve 153 slidably accommodated within the valve guiding bore 152 so as to move in the radial direction in response to the rotational speed of the outer rotor 1 in order to open and close the atmosphere communication passage 151.

Accordingly, a centrifugal force acts on the on-off valves 153 and 157 in response to the rotational speed of the outer rotor 1. Therefore, the faster the rotational speed of the outer rotor 1 becomes, the greater the centrifugal force acting on the on-off valves 153 and 157 becomes, so that the on-off valves 153 and 157 are radially outwardly displaced, thereby closing the respective atmosphere communication passages 151. On the other hand, in a case where the rotational speed of the outer rotor 1 decreases, the centrifugal force acting on the on-off valves 153 and 157 also decreases. Accordingly, the on-off valves 153 and 157 are radially inwardly displaced, so that the atmosphere communication passages 151 are opened. In other words, the valve timing control apparatus having the above-mentioned simple configuration according to the embodiments may allow air to flow into the retarded angle chambers 42 or the advanced angle chambers 43 in order to facilitate the discharge of the operation oil from the retarded angle chambers 42 or the advanced angle chambers 43 while the rotational speed of the outer rotor 1 decreases when the engine is stopped.

According to the first embodiment, each of the first air inlet mechanisms A1 includes the spring 154 for inwardly biasing the on-off valve 153 in the radial direction.

Accordingly, because the valve timing control apparatus according to the embodiments includes the springs 154, the on-off valves 153 and 157 are promptly inwardly displaced in the radial direction by the biasing force generated by the springs 154 when the rotational speed of the outer rotor 1 decreases and the centrifugal force acting on the on-off valves 153 and 157 decreases. As a result, the operation oil is promptly discharged from the retarded angle chambers 42 or the advanced angle chambers 43 in the case where the engine is stopped and the like.

According to the embodiment, the atmosphere communication passage 151 is formed so as to extend straight along the relative rotational axis X of the outer rotor 1.

Accordingly, the bores, which penetrate the outer rotor 1, are used as the respective atmosphere communication passages 151. Therefore, the atmosphere communication passages 151 are easily formed. Furthermore, the atmosphere communication passages 151 are formed so as to orthogonally intersect with the respective valve guiding bores 152. Hence, a clearance is not likely to be formed between the on-off valves 153 and 157 and the respective atmosphere communication bores 151 when the on-off valves 153 and 157 close the respective atmosphere communication passages 151, so that the atmosphere communication passages 151 are surely closed.

According to the embodiments, the lock mechanism 6 includes the engagement groove (162A, 162B, 62), which is formed at one of the inner rotor 2 and the outer rotor 1, and the engagement piece (60A, 60B) provide at the other one of the inner rotor 2 and the outer rotor 1 so as to be engageable and disengageable with/from the engagement groove (162A, 162B, 62), so that the relative rotational phase of the inner rotor 2 is locked at the lock phase when the engagement piece (60A 60B) is engageably inserted into the engagement groove (162A, 162B, 62). Furthermore, the valve timing control apparatus includes the second air inlet mechanism A2 for connecting the engagement groove (62A, 162B, 62) to the outside of the valve timing control apparatus in order to allow air to flow into the engagement groove (162A, 162B, 62) in the case where the relative rotational phase of the inner rotor 2 is within the range between the most retarded angle phase and the lock phase including the most retarded angle phase and the lock phase and where the rotational speed of the outer rotor 1 is low.

Generally, in order to promptly set the relative rotational phase to the intermediate lock phase when the engine is re-started, the lock mechanism 6 needs to be promptly and surely actuated, in addition to the discharge of the operation oil from the retarded angle chambers 42 or the advanced angle chambers 43. Additionally, it may be conceivable that the outer rotor 1 and the inner rotor 2 rotate relative to each other at high speeds when the outer rotor 1 and the inner rotor 2 is about to be fixed at positions at which the lock phase is formed therebetween. In order to actuate the lock mechanism 6 in the above-described condition, the retarded angle lock piece 60A and the advanced angle lock piece 60B need to promptly engageably be inserted into the respective lock recessed portions 162A and 162B (the lock recessed portion 62).

Therefore, the valve timing control apparatus of the embodiments includes the second air inlet mechanism A2, which allows air to flow into the lock recessed portion(s) (162A, 162B, 62) in the case where the relative rotational phase is within the predetermined range between the most retarded angle phase and the lock phase including the most retarded angle phase and the lock phase, and where the rotational sped of the outer rotor 1 becomes low. Accordingly, the retarded angle lock piece 60A and the advanced angle lock piece 60B is promptly and surely engageably inserted into the lock recessed portion(s) (162A, 162B, 62), so that the relative rotational phase is promptly and surely locked at the lock phase. As a result, the re-startability of the engine is further enhanced.

According to the embodiments, the first air inlet mechanisms A1 allow air to flow into the respective retarded angle chambers 42 or the respective advanced angle chambers 43 in the case where the pressure for supplying the operation oil by the operation fluid supply-and-discharge mechanism (76, 77, 176) is low.

Accordingly, air is allowed to flow into the retarded angle chambers 42 or to the advanced angle chambers 43 while a fluid supplying pressure decreases, e.g. while a hydraulic pressure applied to the valve timing control apparatus of the embodiments is cut off after the engine is stopped, so that the discharge of the operation oil from the retarded angle chambers 42 or the advanced angle chambers 43 is facilitated. Therefore, even if the engine is re-started immediately after the engine is stopped, the inner rotor 2 is allowed to smoothly rotate relative to the outer rotor 1, so that the relative rotational phase formed between the outer rotor 1 and the inner rotor 2 is promptly changed to the lock phase.

According to the embodiments, the first air inlet mechanisms A1 connect the respective retarded angle chambers 42 with the outside of the valve timing control apparatus while the relative rotational phase of the inner rotor 2 is within the range between the most retarded angle phase and the lock phase including the most retarded angle phase and the lock phase.

In the case where the ambient temperature is low and the like, the engine may stall while the driving state of the engine is unstable (e.g. while the rotational speed of the engine is low). In the case where the rotational speed of the engine is low, the inner rotor 2 is more likely to be rotated to the vicinity of the position where the outer rotor 1 and the inner rotor 2 establish the most retarded angle phase. In this case, the phase (i.e. the rotational angle) of the inner rotor 2 needs to be changed so as to establish the lock phase (i.e. the predetermined phase) relative to the outer rotor 1 in order to start the engine again. The predetermined phase is a phase formed between the outer rotor 1 and the inner rotor 2 within a range towards the advanced angle phase relative to the most retarded angle phase. However, under the cold temperature condition, the viscosity of the operation oil (e.g. the engine oil) is high. Therefore, the operation oil is likely to remain within the retarded angle chambers 42 or the advanced angle chambers 43. Generally, the relative rotational phase formed between the outer rotor 1 and the inner rotor 2 needs to be greatly changed in order to form the lock phase. However, the returning motion of the inner rotor 2 (i.e. the rotation of the inner rotor 2 in the advanced angle direction S2) is disturbed because of the operation oil remaining within the retarded angle chambers 42. Accordingly, in a known valve timing control apparatus, the relative rotational phase formed between the outer rotor 1 and the inner rotor 2 is not likely to be promptly changed to the lock phase, which may result in deteriorating a re-startability of the engine.

According to the embodiments, while the relative rotational phase formed between the outer rotor 1 and the inner rotor 2 is within the range between the most retarded angle phase and the lock phase including the most retarded angle phase and the lock phase, air is allowed to flow into the retarded angle chambers 42, so that the operation fluid is discharged from the retarded angle chambers 42. As a result, the operation resistance of the inner rotor 2 decreases, so that the relative rotational phase formed between the outer rotor 1 and the inner rotor 2 is promptly changed to the lock phase. Accordingly, the re-startability of the engine is improved.

According to the second embodiment, the first air inlet mechanisms A1 are provided at the outer rotor 1 so as to be positioned in the vicinity of the respective retarded angle chambers 42. The communication passage 53, which connects the corresponding retarded angle chamber 42 and the corresponding first air inlet mechanism A1 while the relative rotational phase of the inner rotor 2 is within the range between the most retarded angle phase and the lock phase including the most retarded angle phase and the lock phase, is formed at the outer circumferential portion of the inner rotor 2.

Accordingly, because the communication passages 53 are formed at the outer circumferential portion of the inner rotor 2, air is surely allowed to flow into the respective retarded angle chambers 42 or the advanced angle chambers 42 while the rotational angle of the inner rotor 2 is within the range between the most retarded angle phase and the lock phase including the most retarded angle phase and the lock phase. Furthermore, the communication passages 53 are easily formed at the outer circumferential portion of the inner rotor 2 by forming grooves at the outer circumferential portion of the inner rotor 2 or by providing cut-offs at the outer circumferential portion of the inner rotor 2. In other words, the first air inlet mechanisms A1 are easily configured.

According to the second embodiment, each of the first air inlet mechanisms A1 includes the communication space 51, within which the operation oil is accommodatable, the first communication port L1 connecting the communication space 51 with the corresponding retarded angle chamber 42 or the corresponding advanced angle chamber 43, the second communication port L2 connecting the communication space 51 with the opening portion 26 opening to the outside of the valve timing control apparatus, and the ball 52A provided within the communication space 51 so as to close and open the second communication port L2.

Accordingly, because each of the first air inlet mechanisms A1 includes the ball 52A for opening/closing the second communication port L2, the ball 52A, which serves as a ball valve, is easily moved. The ball 52A is provided within the communication space 51 so as to contact the operation oil, which flows towards the ball 52A from the first communication port L1 and so as to contact air, which flow towards the ball 52A from the second communication port L2. In other words, the ball 52A is easily displaced in response to a relationship between the hydraulic pressure of the operation oil and an atmospheric pressure. As a result, in the state where the hydraulic pressure of the operation oil is high, the ball 52A is moved towards the second communication port L2, thereby closing the second communication port L2. On the other hand, in a case where the hydraulic pressure of the operation oil decreases or when the operation oil is discharged from the communication space 51, the ball 52A is displaced away from the second communication port L2, so that air is allowed to flow into the communication space.

Accordingly, in the case where the hydraulic pressure of the operation oil decreases, e.g. when the engine is stopped, air is allowed to flow into the communication spaces 51 in order to facilitate the discharge of the operation oil from the retarded angle chambers 42 or the advanced angle chambers 43.

According to the second embodiment, each of the first air inlet mechanisms A1 includes the spring 52B for biasing the ball 52A in a direction away from the second communication port L2.

Accordingly, because each of the first air inlet mechanisms A1 includes the spring 52B, the ball 52B is promptly displaced away from the second communication port L2 in the case where the hydraulic pressure of the operation oil becomes low. As a result, the operation oil is promptly discharged from the retarded angle chambers 42 or the advanced angle chambers 43 in the case where, for example, the engine is stopped.

According to the second embodiment, the lock mechanism 6 includes the lock recessed portion 62, which is formed at one of the outer rotor 1 and the inner rotor 2, and the engagement pieces (60A, 60B), which are provided at the other one of the outer rotor 1 and the inner rotor 2 so as to be engageable and disengageable with/from the lock recessed portion 62. The relative rotational phase of the inner rotor 2 is locked at the lock phase when the engagement pieces (60A 60B) are engageably inserted into the lock recessed portion 62. Furthermore, the valve timing control apparatus includes the second air inlet mechanism A2 for allowing air to flow into the lock recessed portion 62 in the case where the relative rotational phase of the inner rotor 2 is within the range between the most retarded angle phase and the lock phase including the most retarded angle phase and the lock phase and where the rotational speed of the outer rotor 1 is low.

Generally, in order to promptly change the relative rotational phase formed between the outer rotor 1 and the inner rotor 2 to the intermediate lock phase when the engine is re-started, the lock mechanism 6 needs to be promptly and surely actuated, in addition to the discharge of the operation oil from the retarded angle chambers 42 or the advanced angle chambers 43. Additionally, it may be conceivable that the outer rotor 1 and the inner rotor 2 rotate relative to each other at high speeds when the outer rotor 1 and the inner rotor 2 are about to be fixed at positions at which the lock phase is formed therebetween. In order to actuate the lock mechanism 6 in the above-described condition, the retarded angle lock piece 60A and the advanced angle lock piece 60B need to promptly engageably be inserted into the respective lock recessed portions 162A and 162B (the lock recessed portion 62).

Accordingly, the valve timing control apparatus of the embodiments includes the second air inlet mechanism A2 for allowing air to flow into the lock recessed portion 62 in order to actively discharge the operation oil remaining within the lock recessed portion 62 while the relative rotational phase formed between the outer rotor 1 and the inner rotor 2 is within the range between the most retarded angle phase and the lock phase including the most retarded angle phase and the lock phase and while the supply pressure of the operation oil is low. As a result, the retarded angle lock piece 60A and the advanced angle lock piece 60B are promptly and surely engageably inserted into the lock recessed portion 62, so that the relative rotational phase formed between the outer rotor 1 and the inner rotor 2 is promptly and surely locked at the lock phase. As a result, the re-startability of the engine is further improved.

The principles, preferred embodiment and mode of operation of this disclosure have been described in the foregoing specification. However, the disclosure which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the disclosure. Accordingly, it is expressly intended that all such variations, changes and equivalents which fall within the spirit and scope of the disclosure as defined in the claims, be embraced thereby.

The invention claimed is:

1. A valve timing control apparatus comprising:

a driving-side rotating member synchronously rotatable with a crankshaft of an internal combustion engine;

a driven-side rotating member arranged coaxially with the driving-side rotational member so as to be rotatable relative to the driving-side rotating member and integrally rotatable relative to a camshaft that controls opening and closing operations of a valve of the internal combustion engine;

a retarded angle chamber defined by the driving-side rotating member and the driven-side rotating member, the retarded angle chamber used for changing a relative rotational phase of the driven-side rotating member relative to the driving-side rotating member in a retarded angle direction in a manner where a volume of the retarded angle chamber is changed;

an advanced angle chamber defined by the driving-side rotating member and the driven-side rotating member, the advanced angle chamber used for changing the relative rotational phase of the driven-side rotating member relative to the driving-side rotating member in an advanced angle direction in a manner where a volume of the advanced angle chamber is changed;

a lock mechanism locking the relative rotational phase of the driven-side rotating member at a predetermined phase between a most advanced angle phase and a retarded angle phase;

an operation fluid supply-and-discharge mechanism supplying and discharging an operation fluid to and from the retarded angle chamber, the advanced angle chamber and the lock mechanism; and a first air inlet mechanism for connecting one of the retarded angle chamber and the advanced angle chamber to an outside of the valve timing control apparatus in order to allow air to flow into the one of the retarded angle chamber and the advanced angle chamber;

wherein the first air inlet mechanism includes an atmosphere communication passage for connecting an opening portion opened to the outside of the valve timing control apparatus with the one of the retarded angle chamber and the advanced angle chamber, a valve guiding bore formed at the driving-side rotating member so as to extend in a radial direction of the driving-side rotating member and so as to intersect with the atmosphere communication passage, and an on-off valve slidably accommodated within the valve guiding bore so as to move in the radial direction in response to the rotational speed of the driving-side rotating member in order to open and close the atmosphere communication passage;

wherein the opening portion is arranged coaxially with the atmosphere communication passage.

2. The valve timing control apparatus according to claim 1, wherein the first air inlet mechanism allows the air to flow into the one of the retarded angle chamber and the advanced angle chamber in a case where a rotational speed of the driving-side rotating member is low.

3. The valve timing control apparatus according to claim 2, wherein the first air inlet mechanism is provided at the driving-side rotating member at a position where the first air inlet mechanism becomes in communication with the retarded angle chamber while the relative rotational phase of the driven-side rotating member is at the predetermined phase.

4. The valve timing control apparatus according to claim 3, wherein the first air inlet mechanism includes an atmosphere communication passage for connecting an opening portion opened to the outside of the valve timing control apparatus with the one of the retarded angle chamber and the advanced angle chamber, a valve guiding bore formed at the driving-side rotating member so as to extend in a radial direction of the driving-side rotating member and so as to intersect with the atmosphere communication passage, and an on-off valve slidably accommodated within the valve guiding bore so as to move in the radial direction in response to the rotational speed of the driving-side rotating member in order to open and close the atmosphere communication passage.

5. The valve timing control apparatus according to claim 1, wherein the first air inlet mechanism includes a biasing means for inwardly biasing the on-off valve in the radial direction.

6. The valve timing control apparatus according to claim 1, wherein the atmosphere communication passage is formed so as to extend straight along a rotational axis of the driving-side rotating member.

7. The valve timing control apparatus according to claim 2, wherein the lock mechanism includes an engagement groove, which is formed at one of the driven-side rotating member and the driving-side rotating member, and an engagement piece provide at the other one of the driving-side rotating member and the driving-side rotating member so as to be engageable and disengageable with/from the engagement groove, the relative rotational phase of the driven-side rotating member is locked at the predetermined phase when the engagement piece is engageably inserted into the engagement groove, and wherein the valve timing control apparatus further includes a second air inlet mechanism for connecting the engagement groove to the outside of the valve timing control apparatus in order to allow the air to flow into the engagement groove in a case where the relative rotational phase of the driven-side rotating member is within a range between the most retarded angle phase and the predetermined phase including the most retarded angle phase and the predetermined phase and where the rotational speed of the driving-side rotating member is low.

8. The valve timing control apparatus according to claim 3, wherein the lock mechanism includes an engagement groove, which is formed at one of the driven-side rotating member and the driving-side rotating member, and an engagement piece provide at the other one of the driving-side rotating member and the driving-side rotating member so as to be engageable and disengageable with/from the engagement groove, the relative rotational phase of the driven-side rotating member is locked at the predetermined phase when the engagement piece is engageably inserted into the engagement groove, and wherein the valve timing control apparatus further includes a second air inlet mechanism for connecting the engagement groove to the outside of the valve timing control apparatus in order to allow the air to flow into the engagement groove in a case where the relative rotational phase of the driven-side rotating member is within a range between the most retarded angle phase and the predetermined phase including the most retarded angle phase and the predetermined phase and where the rotational speed of the driving-side rotating member is low.

9. The valve timing control apparatus according to claim 1, wherein the lock mechanism includes an engagement groove, which is formed at one of the driven-side rotating member and the driving-side rotating member, and an engagement piece provide at the other one of the driving-side rotating member and the driving-side rotating member so as to be engageable and disengageable with/from the engagement groove, the relative rotational phase of the driven-side rotating member is locked at the predetermined phase when the engagement piece is engageably inserted into the engagement groove, and wherein the valve timing control apparatus further includes a second air inlet mechanism for connecting the engagement groove to the outside of the valve timing control apparatus in order to allow the air to flow into the engagement groove in a case where the relative rotational phase of the driven-side rotating member is within a range between the most retarded angle phase and the predetermined phase including the most retarded angle phase and the predetermined phase and where the rotational speed of the driving-side rotating member is low.

10. The valve timing control apparatus according to claim 5, wherein the lock mechanism includes an engagement groove, which is formed at one of the driven-side rotating member and the driving-side rotating member, and an engagement piece provide at the other one of the driving-side rotating member and the driving-side rotating member so as to be engageable and disengageable with/from the engagement groove, the relative rotational phase of the driven-side rotating member is locked at the predetermined phase when the engagement piece is engageably inserted into the engagement groove, and wherein the valve timing control apparatus further includes a second air inlet mechanism for connecting the engagement groove to the outside of the valve timing control apparatus in order to allow the air to flow into the engagement groove in a case where the relative rotational phase of the driven-side rotating member is within a range between the most retarded angle phase and the predetermined phase including the most retarded angle phase and the predetermined phase and where the rotational speed of the driving-side rotating member is low.

11. The valve timing control apparatus according to claim 6, wherein the lock mechanism includes an engagement groove, which is formed at one of the driven-side rotating member and the driving-side rotating member, and an engagement piece provide at the other one of the driving-side rotating member and the driving-side rotating member so as to be engageable and disengageable with/from the engagement groove, the relative rotational phase of the driven-side rotating member is locked at the predetermined phase when the engagement piece is engageably inserted into the engagement groove, and wherein the valve timing control apparatus further includes a second air inlet mechanism for connecting the engagement groove to the outside of the valve timing control apparatus in order to allow the air to flow into the engagement groove in a case where the relative rotational phase of the driven-side rotating member is within a range between the most retarded angle phase and the predetermined phase including the most retarded angle phase and the predetermined phase and where the rotational speed of the driving-side rotating member is low.

12. The valve timing control apparatus according to claim 1, wherein the first air inlet mechanism allows the air to flow into the one of the retarded angle chamber and the advanced angle chamber in a case where a pressure for supplying the operation fluid by the operation fluid supply-and-discharge mechanism is low.

13. The valve timing control apparatus according to claim 12, wherein the first air inlet mechanism connects the retarded angle chamber with the outside of the valve timing control apparatus while the relative rotational phase of the driven-side rotating member is within a range between the most retarded angle phase and the predetermined phase including the most retarded angle phase and the predetermined phase.

14. The valve timing control apparatus according to claim 12, wherein the first air inlet mechanism is provided at the driving-side rotating member so as to be positioned in the vicinity of the retarded angle chamber, and a communication passage, which connects the retarded angle chamber and the first air inlet mechanism while the relative rotational phase of the driven-side rotating member is within the range between the most retarded angle phase and the predetermined phase including the most retarded angle phase and the predetermined phase, is formed at an outer circumferential portion of the driven-side rotating member.

15. The valve timing control apparatus according to claim 12, wherein the first air inlet mechanism includes a mechanical space, within which the operation fluid is accommodatable, a first communication port connecting the mechanical space and the one of the retarded angle chamber and the advanced angle chamber, a second communication port connecting the mechanical space and an opening portion opening to the outside of the valve timing control apparatus, and a ball provided within the mechanical space so as to close and open the second communication port.

16. The valve timing control apparatus according to claim 15, wherein the first air inlet mechanism includes a biasing means for biasing the ball in a direction away from the second communication port.

17. The valve timing control apparatus according to claim 12, wherein the lock mechanism includes an engagement groove, which is formed at one of the driven-side rotating member and the driving-side rotating member, and an engagement piece, which is provided at the other one of the driven-side rotating member and the driving-side rotating member so as to be engageable and disengageable with/from the engagement groove, the relative rotational phase of the driven-side rotating member is locked at the predetermined phase when the engagement piece is engageably inserted into the engagement groove, and wherein the valve timing control apparatus further includes a second air inlet mechanism for allowing the air to flow into the engagement groove in a case where the relative rotational phase of the driven-side rotating member is within a range between the most retarded angle phase and the predetermined phase including the most retarded angle phase and the predetermined phase and where the rotational speed of the driving-side rotating member is low.

18. The valve timing control apparatus according to claim 13, wherein the lock mechanism includes an engagement groove, which is formed at one of the driven-side rotating member and the driving-side rotating member, and an engagement piece, which is provided at the other one of the driven-side rotating member and the driving-side rotating member so as to be engageable and disengageable with/from the engagement groove, the relative rotational phase of the driven-side rotating member is locked at the predetermined phase when the engagement piece is engageably inserted into the engagement groove, and wherein the valve timing control apparatus further includes a second air inlet mechanism for allowing the air to flow into the engagement groove in a case where the relative rotational phase of the driven-side rotating member is within a range between the most retarded angle phase and the predetermined phase including the most retarded angle phase and the predetermined phase and where the rotational speed of the driving-side rotating member is low.

19. The valve timing control apparatus according to claim 14, wherein the lock mechanism includes an engagement groove, which is formed at one of the driven-side rotating member and the driving-side rotating member, and an engagement piece, which is provided at the other one of the driven-side rotating member and the driving-side rotating member so as to be engageable and disengageable with/from the engagement groove, the relative rotational phase of the driven-side rotating member is locked at the predetermined phase when the engagement piece is engageably inserted into the engagement groove, and wherein the valve timing control apparatus further includes a second air inlet mechanism for allowing the air to flow into the engagement groove in a case where the relative rotational phase of the driven-side rotating member is within a range between the most retarded angle phase and the predetermined phase including the most retarded angle phase and the predetermined phase and where the rotational speed of the driving-side rotating member is low.

20. The valve timing control apparatus according to claim 1, wherein the atmosphere communication passage and the opening portion are both orthogonal to the valve guiding bore.

* * * * *